US006672713B2

(12) United States Patent
Koike et al.

(10) Patent No.: US 6,672,713 B2
(45) Date of Patent: Jan. 6, 2004

(54) INK-JET RECORDING HEAD AND METHOD OF PRODUCING THE SAME

(75) Inventors: Shuji Koike, Setagaya (JP); Yoshiaki Sakamoto, Kawasaki (JP); Tomohisa Shingai, Kawasaki (JP); Seigen Otani, Kawasaki (JP); Toshihiko Osada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/175,157

(22) Filed: Jun. 20, 2002

(65) Prior Publication Data

US 2003/0007036 A1 Jan. 9, 2003

Related U.S. Application Data

(63) Continuation of application No. PCT/JP99/07288, filed on Dec. 24, 1999.

(51) Int. Cl.[7] ..... B41J 2/045
(52) U.S. Cl. ..... 347/68; 347/71
(58) Field of Search ..... 347/68–72; 310/320, 310/328; 204/192.34; 29/890.1, 25.35

(56) References Cited

U.S. PATENT DOCUMENTS 6,109,738 A * 8/2000 Miyata et al. ..... 347/71
6,345,887 B1 * 2/2002 Sato ..... 347/72

FOREIGN PATENT DOCUMENTS

| | | | | |
|---|---|---|---|---|
| EP | 0 786 345 A2 | | 7/1997 | |
| JP | 5-109668 | | 4/1993 | |
| JP | 6-13357 | | 1/1994 | |
| JP | 409220807 A | * | 8/1997 | ..... 347/70 |
| JP | 9-286104 | | 11/1997 | |
| JP | 10-128973 | | 5/1998 | |
| JP | 2000-117990 | | 4/2000 | |
| JP | 2000-190492 | | 7/2000 | |

* cited by examiner

*Primary Examiner*—Stephen D. Meier
*Assistant Examiner*—An H. Do
(74) *Attorney, Agent, or Firm*—Armstrong, Kratz, Quintos, Hanson & Brooks, LLP

(57) ABSTRACT

A highly accurate, downsized ink-jet recording head producible at low cost by using a thin-film deposition technology is provided.

The ink-jet recording head, in which a piezoelectric layer is formed subsequent to an electrode layer on a substrate by using a thin-film deposition technology and an energy-generating element for generating energy for ink ejection is formed by etching the electrode and the piezoelectric layers simultaneously by an ion milling process, includes a fine powder reception part on which mixed fine powders including at least those etched off the electrode layer and the piezoelectric layer by the ion milling process are deposited, the fine powder reception part being provided in a periphery of the energy-generating element.

9 Claims, 24 Drawing Sheets

INK-JET RECORDING HEAD AND METHOD OF PRODUCING THE SAME

This application is a continuation of International Application PCT/JP99/07288 filed Dec. 24, 1999.

TECHNICAL FIELD

The present invention relates to an ink-jet recording head, and more particularly to an ink-jet head formed compactly by using a thin-film deposition technology such as ion milling.

Conventionally, a wire-driving printer head has been widely used as a printer head. The wire-driving printer head performs printing by driving wires magnetically and pressing the wires against a platen with a paper sheet or an ink ribbon interposed therebetween. The wire-dot printer head, however, has many disadvantages such as large power consumption, noise generation, and low resolution, thus leaving much to be desired as a printer device.

Therefore, a printer employing an ink-jet recording head using piezoelectric elements or air bubbles generated by heat has been developed lately. The ink-jet recording head, which is driven noiselessly with low power consumption and achieves high resolution, has come to the front as a preferred printer device.

BACKGROUND ART

The ink-jet recording head basically includes nozzles, ink chambers, an ink supply system, an ink tank, and a pressure-generating part. In a printer using the ink-jet recording head, displacement generated in the pressure-generating part is transmitted to the ink chambers as pressure so that ink particles are sprayed from the nozzles, thereby recording characters or images on a recording medium such as a sheet of paper.

According to the conventional known method, a thin-plate piezoelectric element is attached to one side of the outer wall of an ink chamber as a pressure-generating part. By supplying a pulse-like voltage to the piezoelectric element, a composite plate formed of the piezoelectric element and the outer wall of the ink chamber deflects. Displacement generated by the deflection produces pressure that is applied to the ink chamber, so that ink is sprayed.

FIG. 1 is a schematic diagram showing an ink-jet recording head 10 and its periphery of a conventional printer 1, and FIG. 2 is a perspective view of the ink-jet recording head 10, showing the outline of a configuration thereof.

In FIG. 1, the ink-jet recording head 10 is attached to the lower surface of a carriage 2. The ink-jet recording head 10 is positioned between a feed roller 3 and an eject roller 4 so as to oppose a platen 5. The carriage 2 includes an ink tank 6, and is provided to be movable in a direction perpendicular to the surface of the FIG. 1 sheet. A paper sheet 7 is pinched between a pinch roller 8 and the feed roller 3 and further between a pinch roller 9 and the eject roller 4 to be conveyed in the direction indicated by the arrow A. The ink-jet recording head 10 is driven and the carriage 2 is moved in the direction perpendicular to the sheet surface so that the ink-jet recording head 10 performs printing on the paper sheet 7. The printed paper sheet 7 is stored in a stacker 20.

As shown in FIG. 2, the ink-jet recording head 10 includes piezoelectric elements 11, individual electrodes 12 formed on the piezoelectric elements 11, a nozzle plate 14 having nozzles 13 formed therein, metal or resin ink chamber walls 17 forming, with the nozzle plate 14, ink chambers 15 corresponding to the nozzles 13, and a diaphragm 16.

The nozzles 13 and the diaphragm 16 are positioned to oppose the ink chambers 15. The periphery of the ink chambers 15 and the corresponding periphery of the diaphragm 16 are firmly connected, and the piezoelectric elements 11 cause the respective corresponding parts of the diaphragm 16 to be displaced as indicated by the broken line in FIG. 2. Voltages are applied to the piezoelectric elements 11 by supplying electrical signals from the main body of the printer to the individual piezoelectric elements 11 through a printed board not shown in the drawing. The piezoelectric elements 11 supplied with the voltages contract or expand to cause pressure in the respective ink chambers 15 so that ink is sprayed. Thereby, printing is performed on the recording medium.

The piezoelectric elements 11 are formed on the above-described conventional ink-jet recording head 10 shown in FIG. 2 by attaching plate-like piezoelectric elements to positions corresponding to the ink chambers 15 or by-first attaching a piezoelectric element over the ink chambers 15 and then dividing the piezoelectric element according to the ink chambers 15.

If a thin piezoelectric element (smaller than 50 $\mu$m) is employed in the thus produced conventional ink-jet recording head 10 in order to reduce the size thereof, a variation in the thickness of an adhesive agent used for the attachment causes variations in the displacement of the piezoelectric elements so that the characteristic of the ink head is deteriorated. Further, the piezoelectric element of this type has a problem in that a crack is made therein at the time of attachment.

Some inventors of the present invention, together with another inventor, have proposed a method of producing an ink-jet recording head using a thin-film deposition technology in order to eliminate the above-described disadvantage. However, there is still room for improvement in this method.

DISCLOSURE OF THE INVENTION

That is, a principal object of the present invention is to provide a highly accurate, downsized ink-jet recording head producible at low cost and a method of producing the same by making further improvements with respect to an ink-jet recording head produced by using a thin-film deposition technology.

The above object of the present invention is achieved by an ink-jet recording head in which a piezoelectric layer is formed subsequent to an electrode layer on a substrate by using a thin-film deposition technology and an energy-generating element for generating energy for ink ejection is formed by etching the electrode and the piezoelectric layers simultaneously by an ion milling process, the ink-jet recording head including a fine powder reception part on which mixed fine powders including at least those etched off the electrode layer and the piezoelectric layer by the ion milling process are deposited, the fine powder reception part being provided in a periphery of the energy-generating element.

In the present invention, an energy-generating element having integrality can be produced since the electrode layer and the piezoelectric layer are etched simultaneously by ion milling.

Further, a large area can be processed by etching by ion milling, and etching anisotropy is high in a vertical direction with respect to the processed surface. Accordingly, the shape of the energy-generating element can be designed freely, and its etched sections are vertical without any unnecessary taper parts formed thereon.

Mixed fine powders generated by the ion milling are deposited on a fine powder reception part. Therefore, the mixed fine powders are prevented from adhering to the important energy-generating element.

The mixed fine powders deposited on the fine powder reception part can be removed easily by the physical force of pressurized liquid or gas. Therefore, the removal process can be performed in a short period of time at low cost. Accordingly, a downsized ink-jet recording head having high accuracy and reliability can be provided at low cost.

Further, the fine powder reception part can be formed as an island-like member provided at a position 300 μm or less apart from an end of the energy-generating element.

When there exists space including a length exceeding 300 μm from the end of the energy-generating element, by providing the island-like member at a position 300 μm or less apart from the end of the energy-generating element, the mixed fine powders can be deposited on the member. Therefore, the mixed fine powders are prevented from adhering to the important energy-generating element.

Further, the island-like member can be formed as an auxiliary frame body for reinforcing the ink-jet recording head. The auxiliary frame body performs not only the function of reinforcing the ink-jet recording head but also the function of preventing-the mixed fine powders from adhering to the energy-generating element.

Further, the island-like member or the auxiliary frame body can be formed at the same time that the electrode and piezoelectric layers are ion-milled. That is, this can be easily performed by changing a photoresist pattern used in forming the energy-generating element to a pattern that preserves the island-like member or the auxiliary frame body.

Further, the fine powder reception part can be formed as an annular groove provided around the energy-generating element so that the energy-generating element can be formed therein.

The mixed fine powders can be deposited on an outer wall surface inside the groove by simply providing the annular groove on which the mixed fine powders are to be formed. The groove is preferably 300 μm or less in width.

The groove can be formed at the same time that the electrode and piezoelectric layers are ion-milled. That is, this can be easily performed by altering the photoresist pattern used in forming the energy-generating element.

Further, the above object of the present invention is also achieved by a method of producing an ink-jet recording head, the method including the steps of: forming a piezoelectric layer subsequent to an electrode layer on a substrate by using a thin-film deposition technology; forming an energy-generating element for generating energy for ink ejection by etching the electrode and the piezoelectric layers simultaneously by an ion milling process, and forming a fine powder reception part on which mixed fine powders including at least those etched off the electrode layer and the piezoelectric layer by the ion milling process are deposited, the fine powder reception part being provided in a periphery of the energy-generating element; and removing the fine powders deposited on the fine powder reception part.

By ion milling, the energy-generating element can be formed by etching the electrode and piezoelectric layers at the same time, and the fine powder reception part is formed simultaneously with the energy-generating element. The fine powders are deposited on the fine powder reception part. Therefore, the ink-jet recording head can be produced without the fine powders adhering to the energy-generating element. Further, the mixed fine powders formed on the fine powder reception part can be removed easily in the subsequent removal process.

The fine powder reception part can be formed simultaneously with the energy-generating element by altering the photoresist pattern. Accordingly, this can be performed easily by making a simple alteration to the photoresist pattern.

The fine powder reception part can be an island-like member provided at a position 300 μm or less apart from the end of the energy-generating element.

The fine powder reception part can be an annular groove provided for forming the energy-generating element, the annular groove being 300 μm or less in width.

The process for removing the mixed fine powders can be provided to physically remove the mixed fine powders by using pressurized liquid or gas. The mixed fine powders can be removed with simple facilities, so that the production cost can be reduced.

Further, another object of the present invention is to provide a printer including the above-described ink-jet recording head. Since the downsized, highly reliable ink-jet recording head produced at low cost is employed, the printer can be reduced in cost.

BEST MODE FOR CARRYING OUT THE INVENTION

Figure 1:
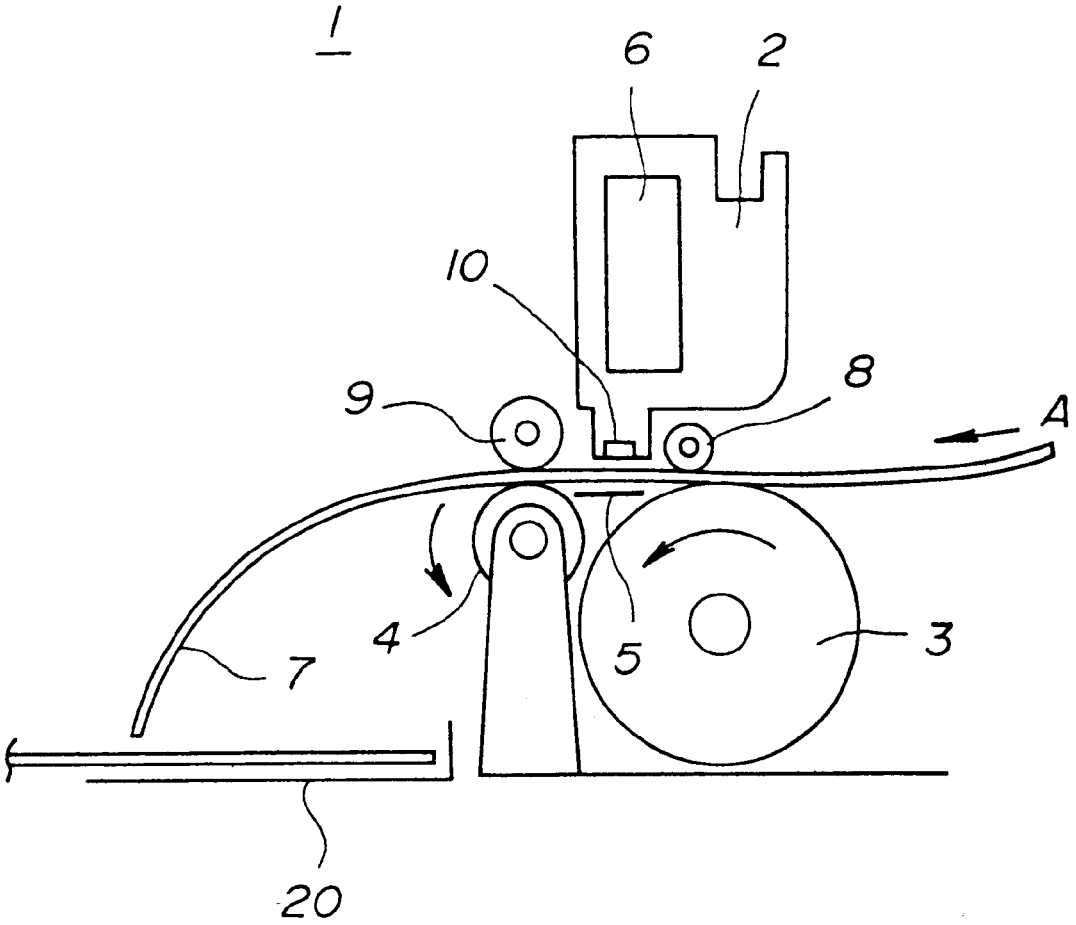
FIG. 1 PRIOR ART
FIG. 1 is a schematic diagram showing an ink-jet recording head and its periphery of a conventional printer.
Figure 2:
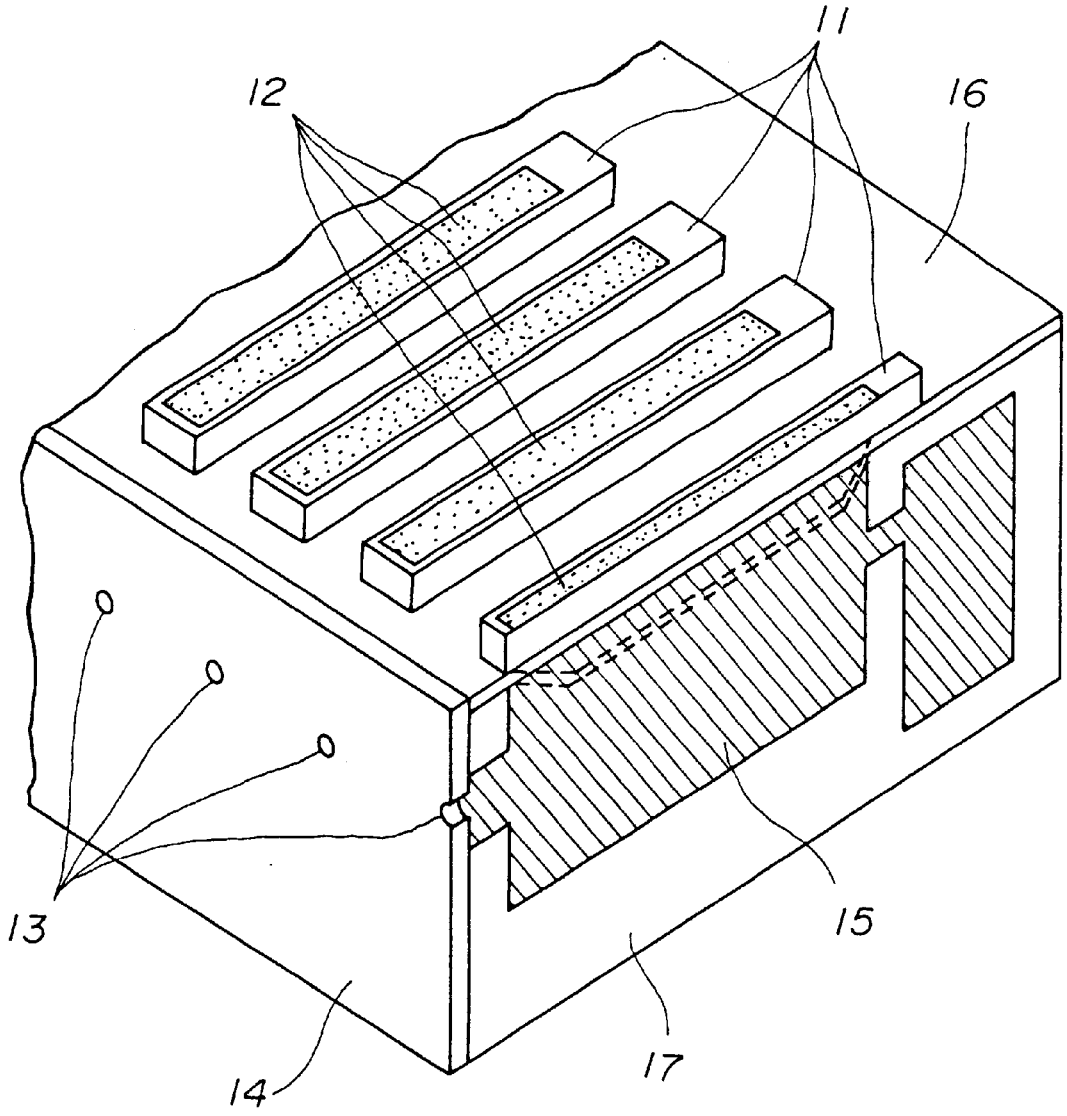
FIG. 2 PRIOR ART
FIG. 2 is a perspective view of the ink-jet recording head of FIG. 1, showing an outline of a configuration thereof.

The present invention relates to improvement of the ink-jet recording head using the thin-film deposition technology proposed previously by the inventors including some inventors of the present invention. In order to help understand the present invention, a description will first be given of the ink-jet recording head proposed by the inventors and of improvements to be made in the present invention, and then, a detailed description will be given of the present invention.

(Previously Proposed Invention)

In a bid to provide an ink-jet recording head reduced further in size from a totally novel point of view, the inventors have devised, through intensive studies, an ink-jet recording head produced by using a thin-film deposition method. A patent application has been filed for the ink-jet recording head (Japanese Patent Application No. 10-297919). A brief description will be given of this invention. FIG. 3 is a diagram showing a production process of an ink-jet recording head 30 devised previously by the inventors.

The ink-jet recording head 30 is produced through steps shown in FIGS. (A) through (H). An electrode layer 31 is formed of a platinum (Pt) film on a magnesium oxide (MgO) substrate 40 by sputtering. The electrode layer 31 is patterned and divided so that individualized electrode layer (hereinafter referred to as individual electrodes) 38 is formed (FIGS. 3(A), (B)). Next, a piezoelectric layer 32 is formed thereon by sputtering (FIG. 3(C)). The piezoelectric layer 32 is patterned and divided so as to correspond to the individual electrodes 38. Formed thereby are energy-generating elements 37, which are formed of laminations of individualized piezoelectric layers (hereinafter referred to as piezoelectric elements) 33 and the individual electrodes 38 and serve as a part generating energy for ink ejection (FIG. 3(D)). Next, a polyimide layer 41 is formed on the upper surface of the MgO substrate 40 for planarization thereof (FIG. 3(E)). Next, sputtering of chromium (Cr) is performed on the upper surface thereof so that a diaphragm 34, which is a Cr sputtering film, is formed (FIG. 3(F)). Next, a dry film 42 is applied on the diaphragm 34, and exposure and development are performed using a mask on the dry film 42 at positions corresponding to the energy-generating elements 37 so that pressure chambers 35 are formed (FIG. 3(G)). Finally, the MgO substrate 40 is removed by etching. Thus, an upper half body 30A of the ink-jet recording head 30 is formed. A lower half body 30B that has the lower concave parts of the pressure chambers 35 and a nozzle plate 44 having nozzles corresponding to the pressure chambers 35 is joined to the upper half body 30A so that the ink-jet recording head is formed (FIG. 3(H)).

Figure 4:
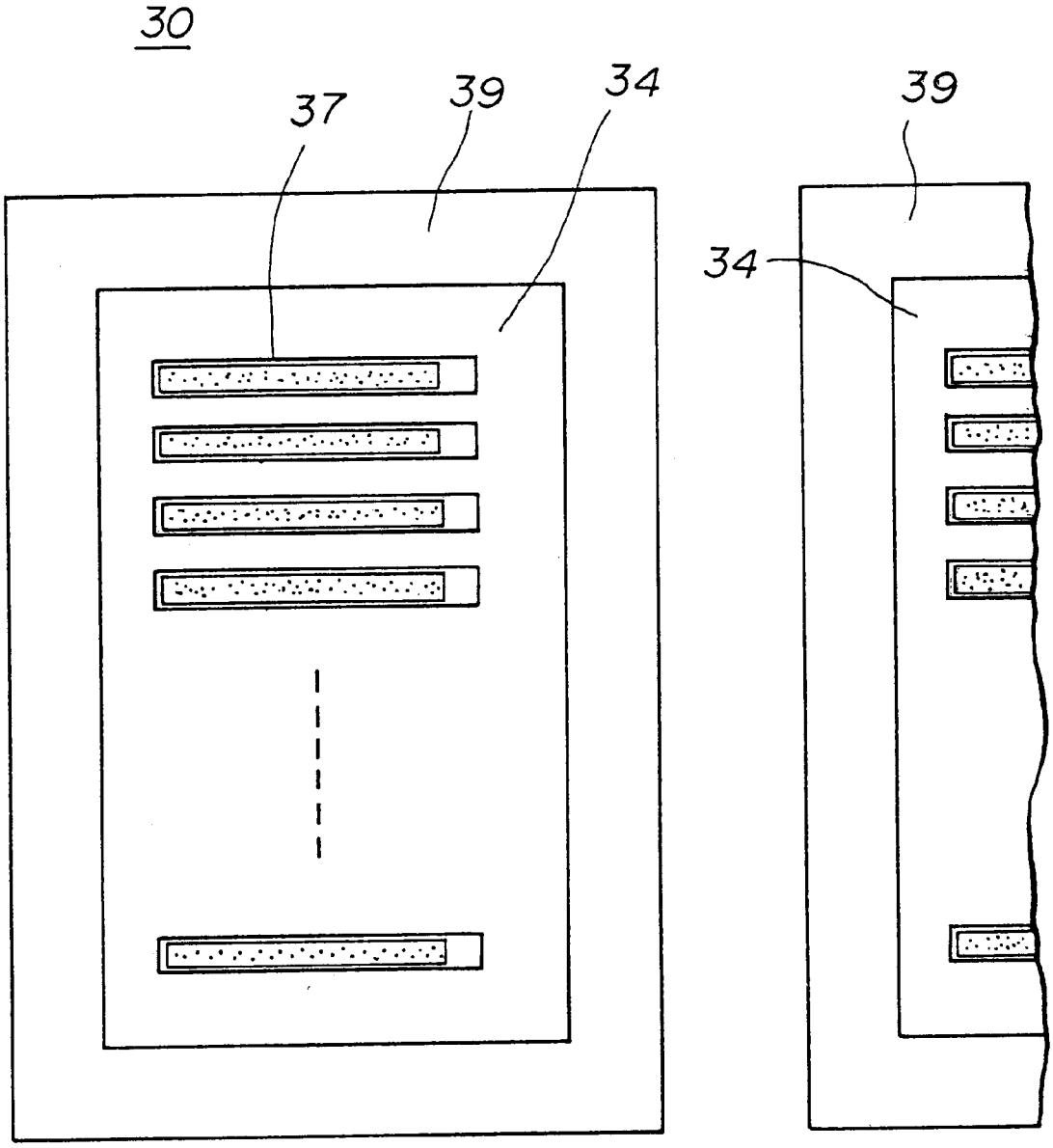
FIG. 4 is a diagram showing an ink-jet recording head having a diaphragm provided with a reinforcement member, the ink-jet recording head being previously devised by the inventors.

Further, the inventors of the above-described ink-jet recording head 30 made an invention of providing a reinforcement member 39 for the diaphragm 34 as shown in FIG. 4, for instance, to prevent a crack from being formed in the diaphragm 34. A patent application has been also filed for this (Japanese Patent Application No. 10-371033).

However, the technology of producing an ink-jet recording head using the thin-film deposition technology is new, and the above-described ink-jet recording head 30 still has room for improvement.

Figure 3A:
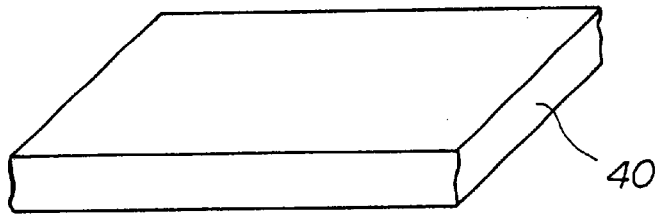
FIGS. 3(A) through 3(H) are diagrams showing a production process of an ink-jet recording head devised by some inventors of the present invention and another inventor.
Figure 3B:
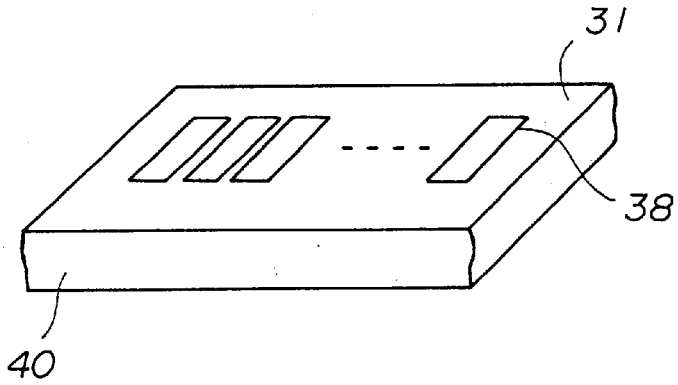
Figure 3C:
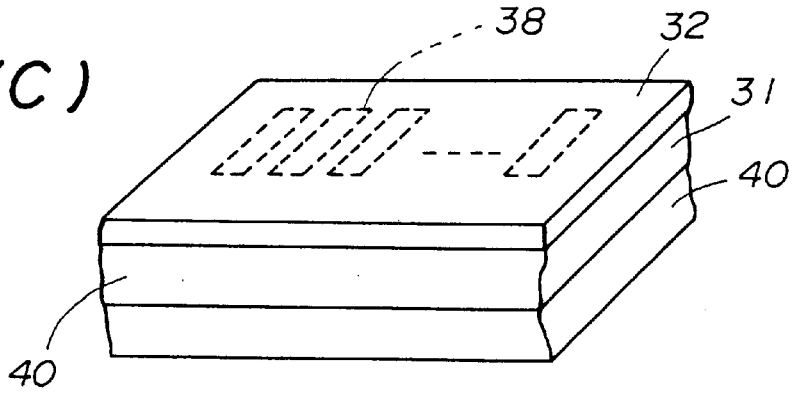
Figure 3D:
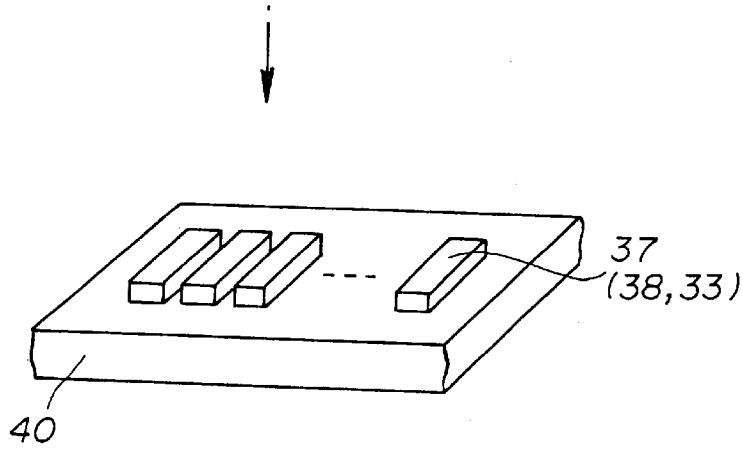
Figure 3E:
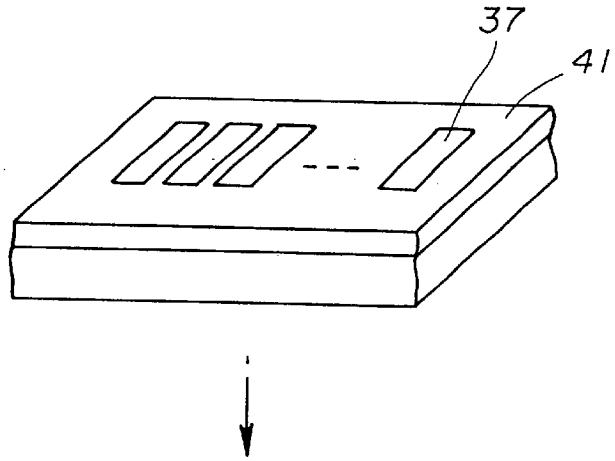
Figure 3F:
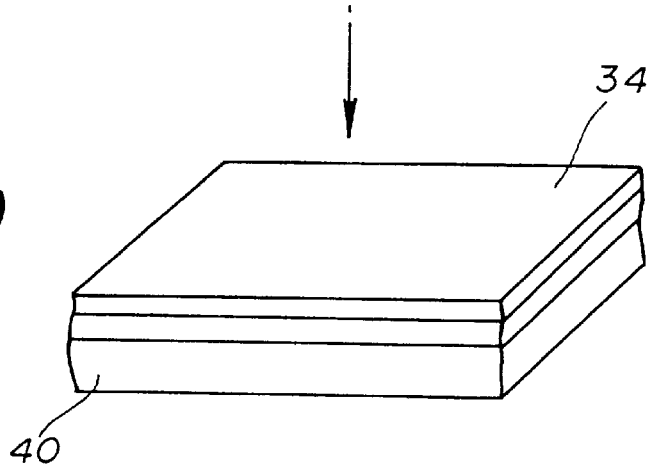
Figure 3G:
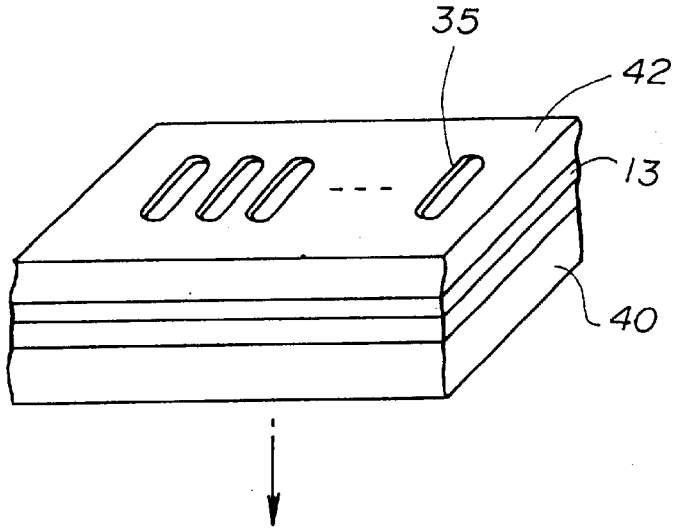
Figure 3H:
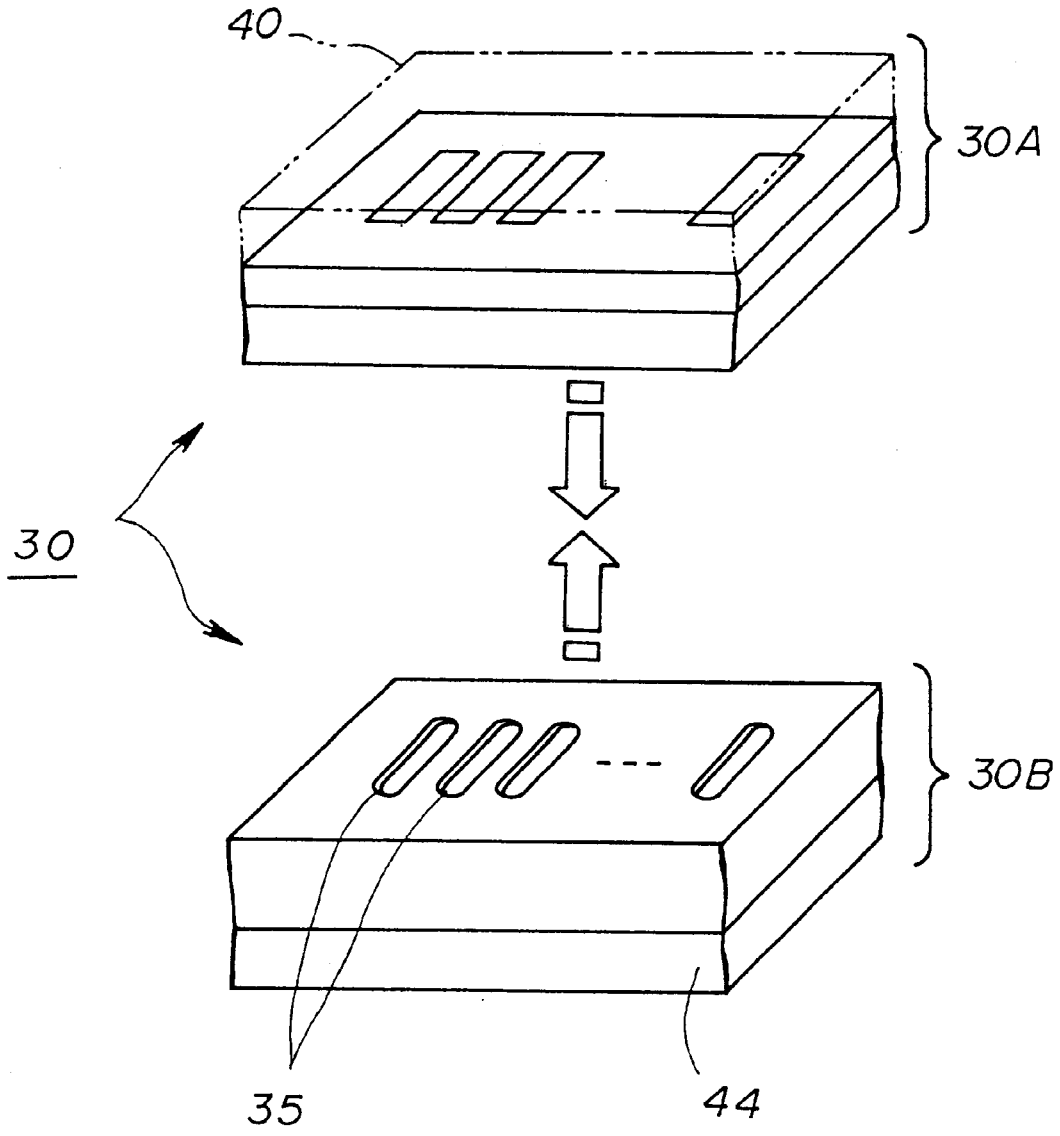

That is, in the production process shown in FIG. 3, the Pt film 31 is formed on the substrate 40 by sputtering, and the individual electrodes 38 are formed by dividing the Pt film 31 (FIGS. 3(A), (B)). The piezoelectric layer 32 is formed all over the lamination of FIG. 3(B) by sputtering (FIG. 3(C)), and the piezoelectric layer 32 is divided into the piezoelectric elements 33 by wet etching so that the energy-generating elements 37, which are the laminations of the individual electrodes 38 and the piezoelectric elements 33, are formed (FIG. 3(D)). Therefore, patterning is performed twice, and the individual electrodes 38 and the piezoelectric elements 33 are positioned so as to be reliably superimposed so that the energy-generating elements 37 are formed.

Further, since the patterning employs wet etching, etching is performed isotropically so that inclined tapered parts are formed around the piezoelectric elements 33. The tapered parts exist around the piezoelectric elements 33 that contact the individual electrodes 38 (upper electrodes) and the diaphragm 34 (lower electrode) to generate displacement, and become non-displacement parts to which no voltage is applied. This restricts the displacement of the piezoelectric elements 33.

(Improvements to be Made in the Present Invention)

The inventors confirmed that improvements can be made, by performing patterning using ion milling, in the above-described two patterning processes, positioning of the individual electrodes 38 and the piezoelectric elements 33, and the tapered parts formed around the piezoelectric elements 33.

That is, ion milling has high etching anisotropy, so that the electrode layer 31 and the piezoelectric layer 32 can be processed at the same time. Accordingly, the electrode layer 31 and the piezoelectric layer 32 are successively formed on the substrate 40, and thereafter, the electrode layer 31 and the piezoelectric layer 32 in a layered state are etched by ion milling at the same time. Thereby, the energy-generating elements 37 formed of the individual electrodes 38 and the piezoelectric elements 33 can be formed in a single patterning process, and the positioning error can be eliminated. Thus, the energy-generating elements can be produced with high accuracy.

In the case of employing ion milling, however, a mixture of fine powders etched off the electrode layer 31 and the piezoelectric layer 32, and further the substrate 40 when ion milling is performed thereon, is deposited around and hardened so that wall-like deposits (hereinafter referred to as fences) are generated.

Figure 5:
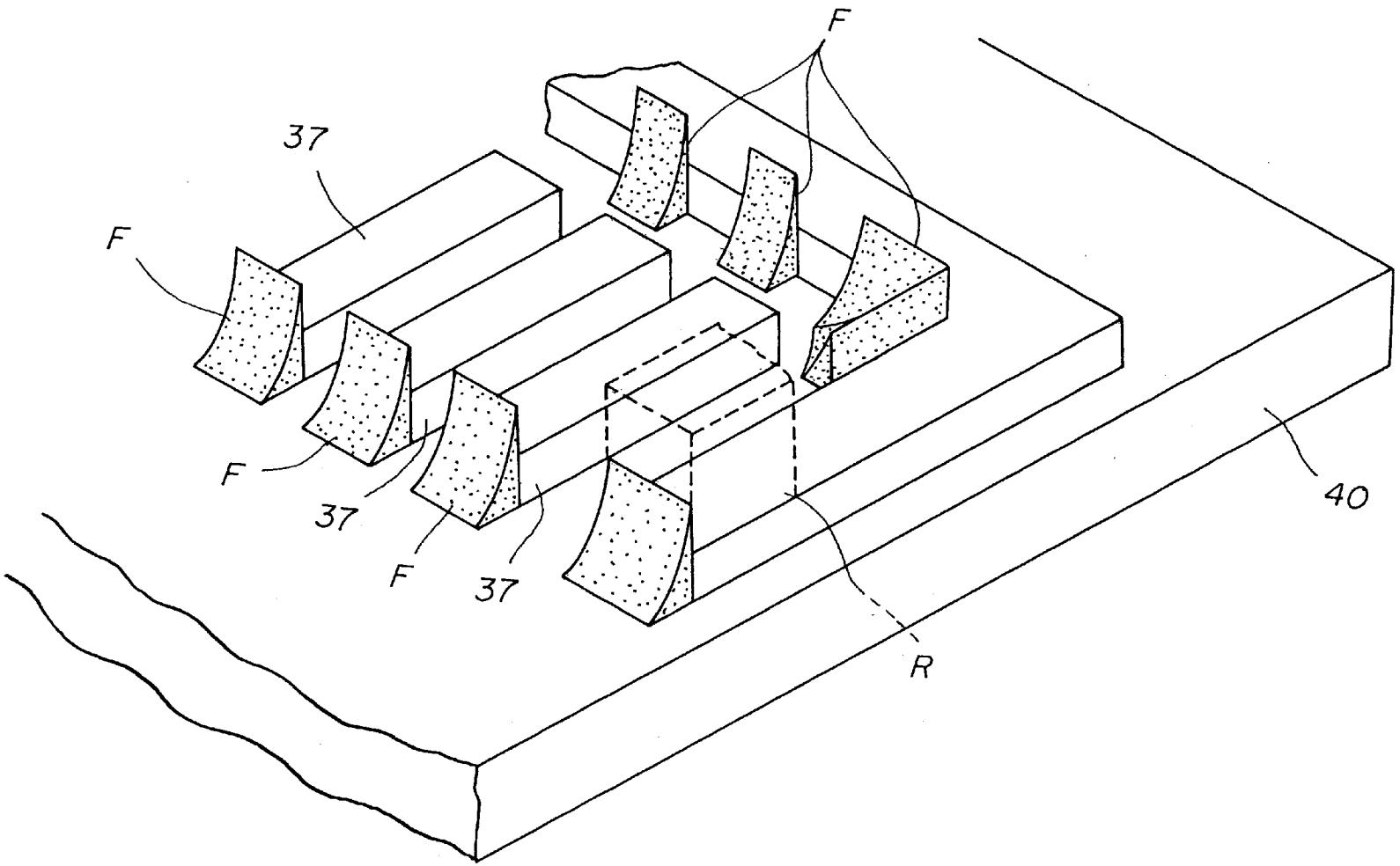
FIG. 5 is a diagram showing typical fences F formed around energy-generating elements.

FIG. 5 is a diagram showing typical fences F formed around the energy-generating elements 37. In processing by ion milling, a resist R is placed for protection on layer parts to be preserved so that unwanted parts are removed, hit by a high-speed argon gas. The parts preserved and divided by this operation later become an energy-generating part causing ink to be sprayed from the ink-jet recording head. As described above, these parts are the laminations of the individual electrodes 38 and the piezoelectric elements 33, and are described as the energy-generating elements 37 in this specification.

When ion milling is performed with the required resist R being placed on the lamination of the electrode layer 31 and the piezoelectric layer 32 formed on the substrate 40, the mixture of the fine powders etched off the electrode layer 31, the piezoelectric layer 32, and the substrate 40 is hardened to form the fences F. As shown in FIG. 5, the fences F are generated mainly at longitudinal end parts and adhere thereto.

FIG. 5 shows the state of the fences F after ion milling and removal of the resist R. The resist R exists on the upper surfaces of the protected parts immediately after the ion milling. With the resist R existing, the deposition of the fences F advances, using the resist R, partly indicated by a broken line, as upper-side support walls.

In ion milling, as described in FIG. 3, a number of processes further follow, such as formation of the polyimide layer 41 as an insulating film and formation of the film of the diaphragm 34 so as to form the ink-jet recording head 30. Particularly, smoothness is required in the formation of the polyimide layer 41 and the diaphragm 34.

Therefore, the fences F should be removed as much as possible. Methods for removing a foreign substance of this kind include CMP (chemical mechanical polishing), wet etching, and a technique of physically removing the fences F by spraying pressurized liquid or gas thereonto and applying force thereto.

Of these, CMP and wet etching can remove the fences F with relative cleanness, but require time in processing, thus resulting in higher processing cost.

On the other hand, the physical method, according to which high pressure liquid or gas is sprayed onto the fences F so that the fences F are broken and washed away, can be executed in a short time with simple facilities at low cost. However, as shown in FIG. 5, the fences F also adhere to the energy-generating elements 37. Forced breakage of the fences F by pressure also damages the energy-generating elements 37.

(Description of the Present Invention)

A description will be given below of the present invention, in which the above-described aspects are improved.

A description will be given of embodiments in which island-shaped members are formed as fine powder reception parts for preventing the fences F from being formed on energy-generating elements that are formed as individual electrodes serving as upper electrodes and voltage bodies.

The island-shaped members are provided apart from the energy-generating elements at positions within 300 $\mu$m from the ends of the energy-generating elements. By providing the island-shaped members, the fences F, which are otherwise formed on the energy-generating elements, can be formed on the island-shaped members. If space including a length larger than 300 $\mu$m from the ends of the energy-generating elements is created therearound as a result of ion milling for forming the energy-generating elements, the above-described island-shaped members are provided. The island-shaped members can be formed by slightly altering the design of a resist pattern at the time of forming the energy-generating elements. The thus formed island-shaped members (hereinafter simply referred to as island parts) are the same laminations as the energy-generating elements.

Here, a description will be given, based on FIG. 6, of an arrangement of the island parts for preventing the fences F from being formed on the energy-generating elements.

FIG. 6 is a diagram showing arrangements of island parts 70 with respect to energy-generating elements 67 of an ink-jet recording head. FIG. 6(A) shows a case where a rectangular island part 70A is provided for a rectangular energy-generating element 67A. Here, the distance L1 between the end of the energy-generating element 67A and the island part 70A is set to 300 $\mu$m or less. Further, the width B of the island part 70A is preferably set larger than or equal to the width b of the energy-generating element 67A. This is because if the width B of the island part 70A is narrower than the width b of the energy-generating element 67A, a fence may be formed on the end of the energy-generating element 67A.

As a result of intense studies conducted by the inventors of the present invention, it has been found that in the case of etching the lamination of an electrode layer and a piezoelectric layer by ion milling, a fence is formed on the divided and formed energy-generating element if space including a length larger than 300 $\mu$m from an end X of the end 67A of the energy-generating element is formed. Further, a certain law has been confirmed that when space including a length larger than 300 $\mu$m exists in the periphery of the energy-generating element, the fence F, which is otherwise formed on the end X1 of the energy-generating element 37A, is displaced to be formed on the end Y1 of the island part 70A by providing the island part 70A so that the conditions of generation of a fence are to be broken, that is, by providing the island part 70A at a position within 300 $\mu$m from the end X of the end 67A of the energy-generating element.

Figure 6A:
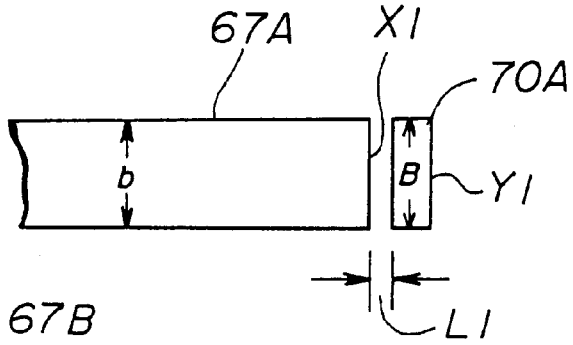
FIGS. 6(A) through 6(D) are diagrams showing arrangements of island parts with respect to energy-generating elements.
Figure 6B:
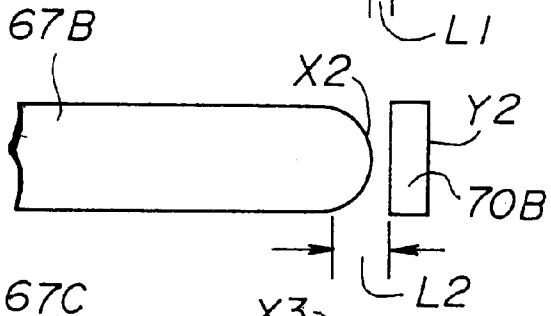

FIG. 6(B) shows a case where a rectangular island part 70B is provided for a rectangular energy-generating element 67B whose corner parts are chamfered. In this case, the distance L2 between each side of the end X2 of the energy-generating element 67B and the island part 70B is longer by an amount by which the corner parts of the energy-generating element 67B are rounded. In this case, by arranging the island part 70B so that L2 may not exceed 300 $\mu$m, the fence F can be displaced to be formed on an end Y2 as in the case of FIG. 6(A).

Figure 6C:
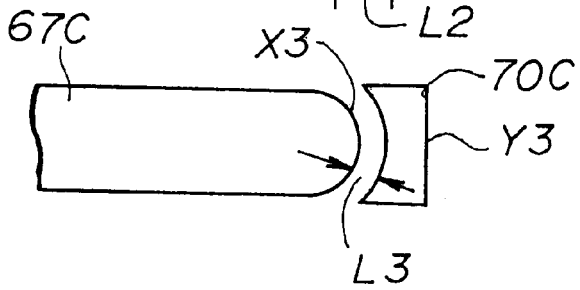

FIG. 6(C) shows a case where, for a rectangular energy-generating element 67C whose corner parts are chamfered, an island part 70C in which an arc is formed in accordance with the chamfering is provided. In this case, the side of the island part 70C which side opposes the energy-generating element 67C is shaped like an arc, so that the distance L3 between the end X3 of the energy-generating element 67C and the island part 70C is substantially constant. In this case, the fence F can also be displaced to be formed on an end Y3 as in the case of FIG. 6(A) by arranging the island part 70C so that L3 may not exceed 300 $\mu$m.

In terms of prevention of generation of a crack in a later-described diaphragm formed on the energy-generating element 67, it is effective to chamfer the corner parts of the energy-generating element 67 roundly.

Figure 6D:
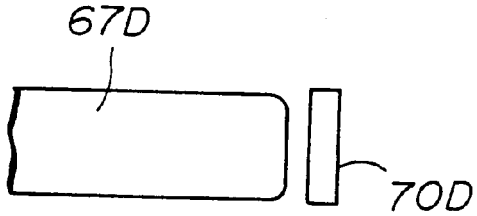

FIG. 6(D) shows a case where a rectangular island part 70D is provided for a substantially rectangular energy-generating element 67D whose corner parts have reduced chamfered areas. If chamfering is provided in this way, no consideration should be given of the elongation of distance on either side.

A description will be given below of more specific arrangements of the energy-generating elements and the island parts in an ink-jet recording head.

Figure 7:
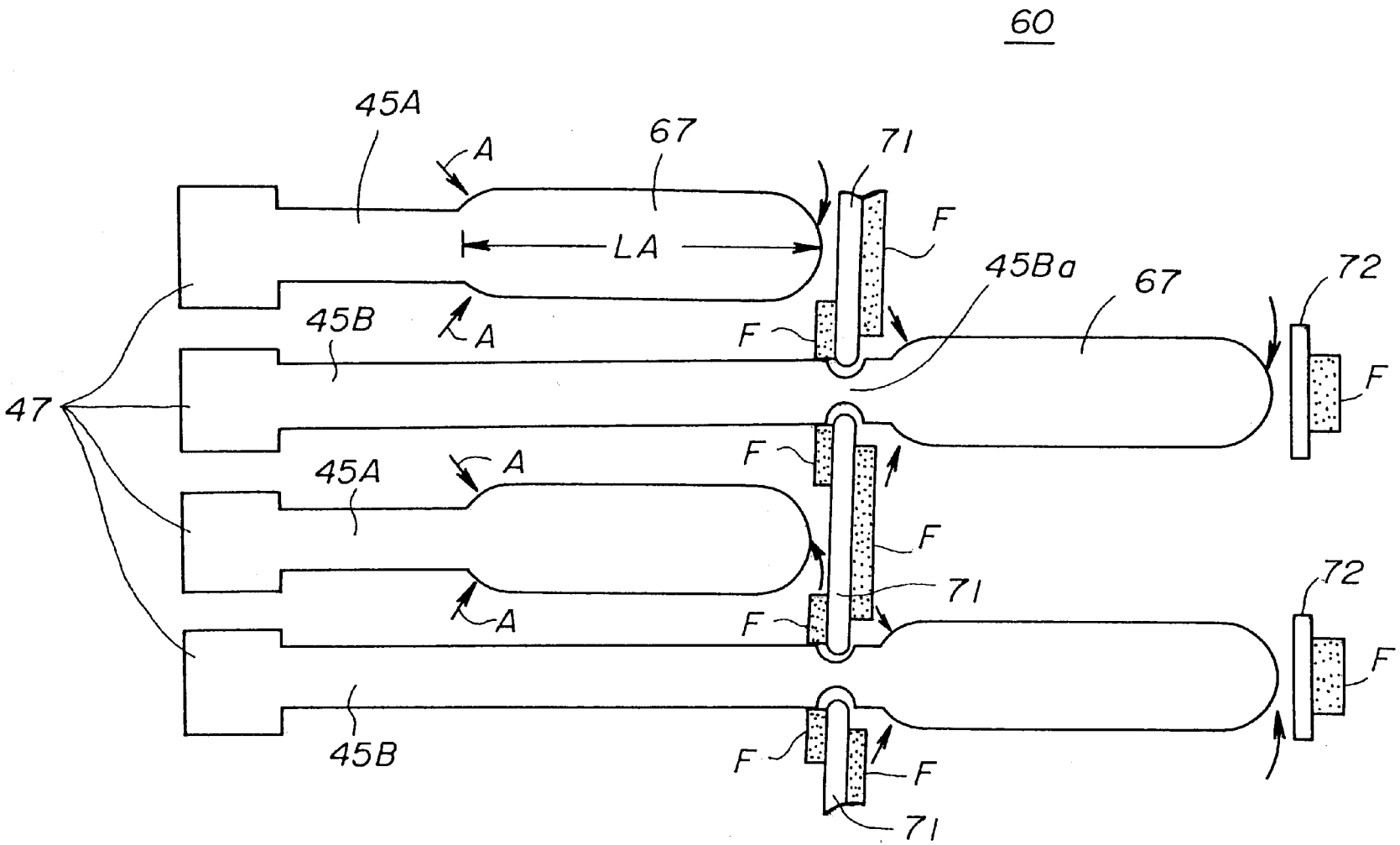
FIG. 7 is a diagram showing an arrangement of energy-generating elements of an ink-jet recording head according to a first embodiment of the present invention.

FIG. 7 is a diagram showing an arrangement of the energy-generating elements 67 of an ink-jet recording head 60 according to a first embodiment. In the first embodiment, as described based on FIG. 6, island parts 71 and 72 are provided, in order to prevent formation of the fences F, in the periphery of the energy-generating elements 37 where the fences F may be formed.

In FIG. 7, the energy-generating elements 67 (four are illustrated in FIG. 7) are arranged zigzag so that a plurality of ink-jet recording heads are arranged. Each energy-generating element 67 is connected integrally with a short interconnection part 45A or a long interconnection part 45B. An electric connection part 47 is formed at the same position on the left end of each interconnection part so that connection with interconnection lines not shown in the drawing can be facilitated.

In FIG. 7, each energy-generating element 67 has a length LA in the longitudinal direction of approximately 700 μm, each short interconnection part 45A is approximately 300 μm, and each long interconnection part 45B is approximately 1000 μm. When the resist pattern shown in FIG. 7 is formed and subjected to etching by ion milling, the fences F are generated at the parts of the energy-generating elements 67 which parts are indicated by arrows.

However, in the first embodiment, the fences F can be displaced to be formed on the island parts 71 and 72 at positions indicated by letters F by arranging the island parts 71 in the middle and the island parts 72 at the end. That is, generation of the fences F that adhere to the energy-generating elements 67 is prevented by providing the island parts in the periphery of the energy-generating elements 67 where the fences F may be formed. A basis on which the island parts are arranged is as described with reference to FIG. 6.

In FIG. 7, the fences F are formed in any place where space etched by ion milling and exceeding 300 μm in length exists. Here, however, the positions at which the fences F are formed on the energy-generating elements 67 and the positions at which the fences F are displaced to be formed on the island parts are shown.

Further, each short interconnection part 45A is approximately 300 μm, and if it exceeds 300 μm, the fences F will form at positions indicated by the arrows A. However, if the short interconnection part 45A is 300 μm or less in length, generation of the fences F can be avoided without providing the island parts. When the design condition of an ink-jet recording head forces the short interconnection parts 45A to exceed 300 μm in length, new islands should be provided in their periphery.

Further, each long interconnection part 45B has concave parts 45Ba narrowing the width thereof to receive the island parts 71. This is to prevent the fences F from adhering to the energy-generating elements 67 since the fences F adhere to the energy-generating elements 67 if there are gaps between the long interconnection parts 45B and the island parts 71.

Figure 8:
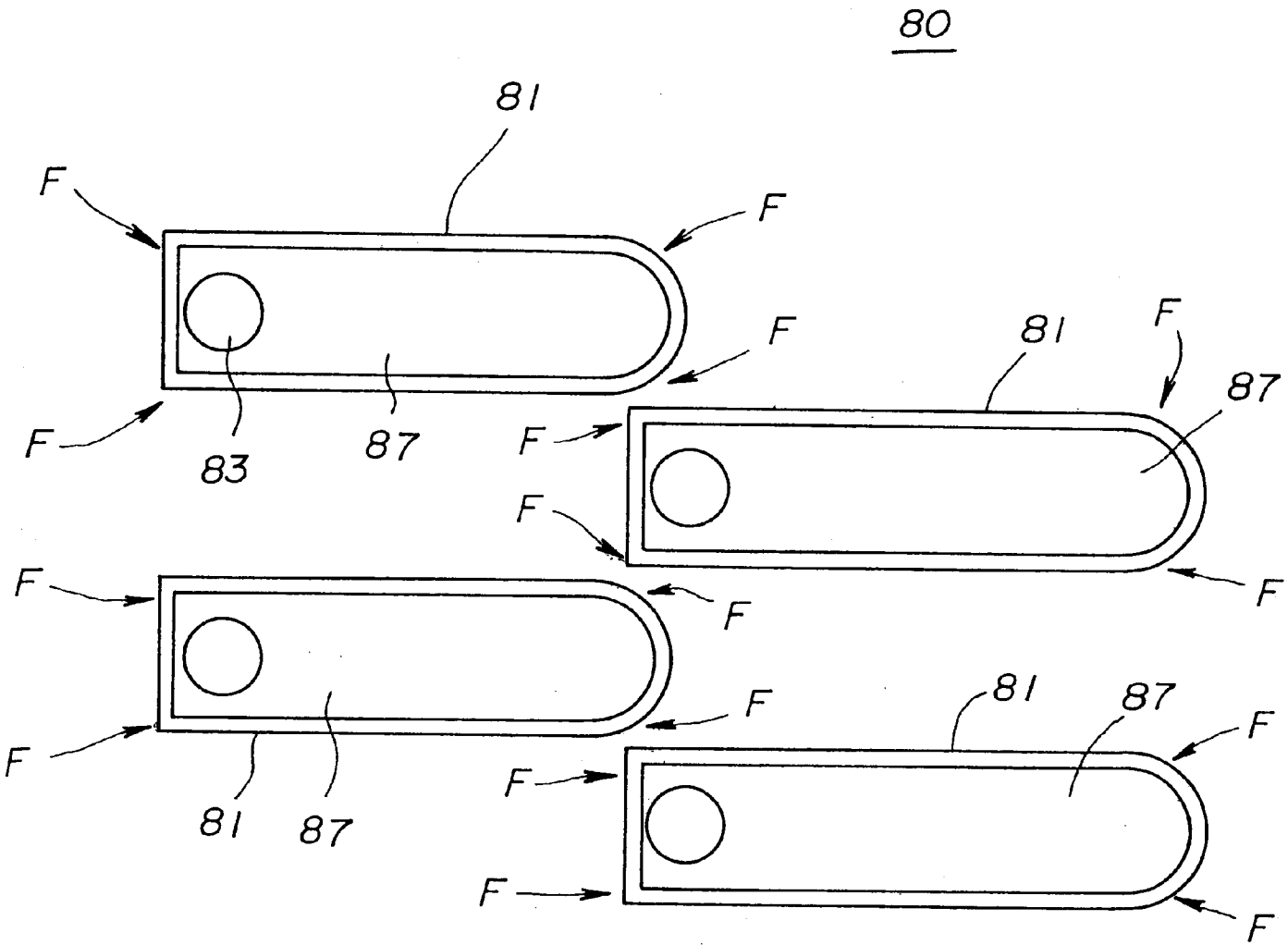
FIG. 8 is a diagram showing an arrangement of energy-generating elements of an ink-jet recording head according to a second embodiment of the present invention.

FIG. 8 is a diagram showing an arrangement of energy-generating elements 87 of an ink-jet recording head 80 according to a second embodiment of the present invention. In the second embodiment, an area etched by ion milling is limited to a minimum required to form the energy-generating elements 87 separately from one another, considering the fact that a length exceeding 300 μm is necessary in the formation of the fences F.

In FIG. 8, grooves 81 each of approximately 10 μm in width are annularly formed by ion milling on the lamination of a electrode layer and a piezoelectric layer, and the energy-generating elements 87 are formed inside the grooves 81. In the case of FIG. 8, if each energy-generating element 87 is approximately 700 μm in length in the longitudinal direction, for instance, the fences F are only slightly formed on the outside parts indicated by the arrows F inside the grooves 81. Further, no fences F adhere to the energy-generating elements 87. Electric connection parts 83 connected with electrodes not shown in the drawing are provided in the energy-generating elements 87.

Figure 9:
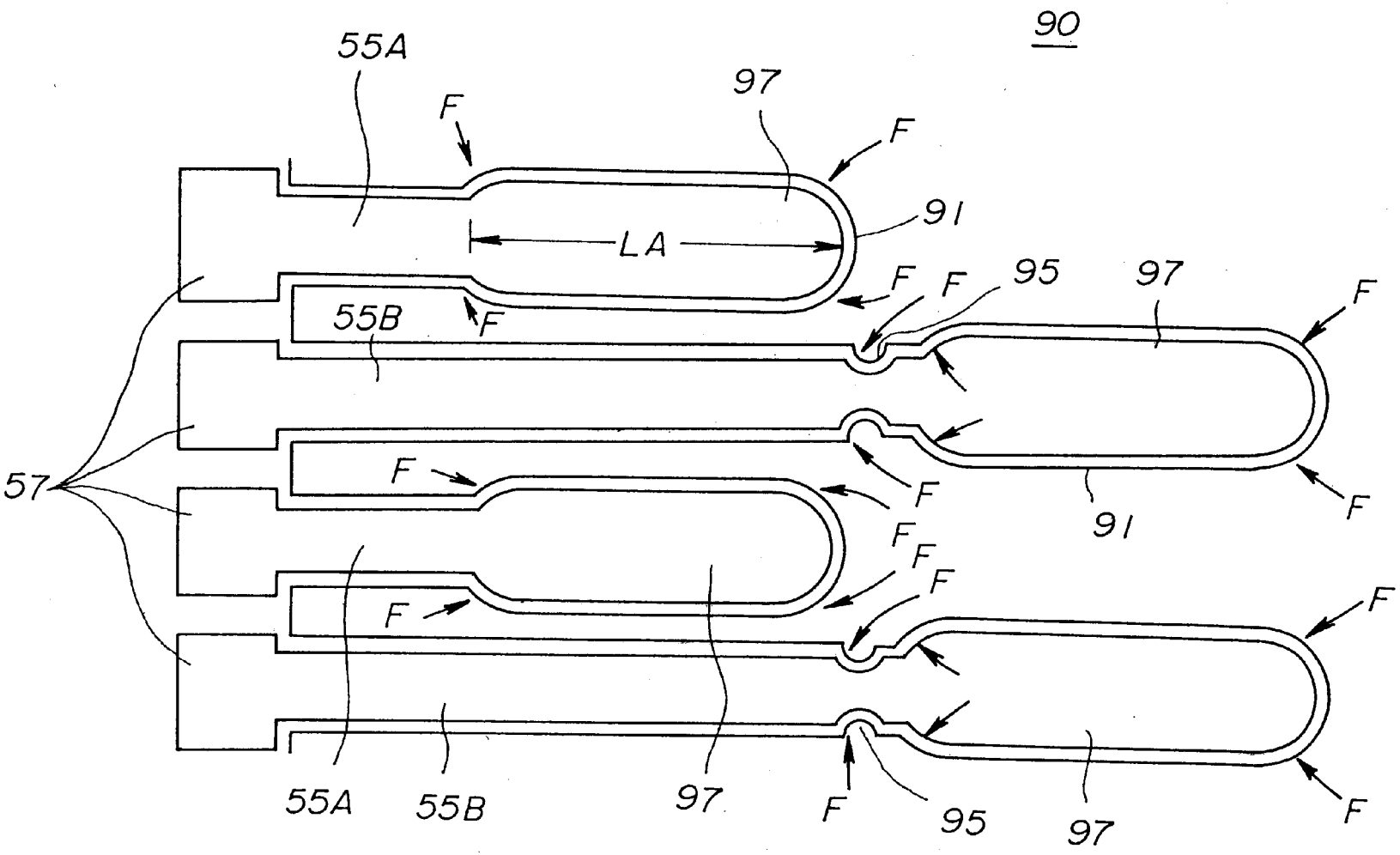
FIG. 9 is a diagram showing an arrangement of energy-generating elements of an ink-jet recording head according to a third embodiment of the present invention.

FIG. 9 is a diagram showing an arrangement of energy-generating elements 97 of an ink-jet recording head 90 according to a third embodiment. In the third embodiment, the same zigzag arrangement as that of the energy-generating elements 67 of the first embodiment is realized with grooves 91 formed by ion milling.

Each energy-generating element 97 is connected integrally with a short interconnection part 55A or a long interconnection part 55B. An electric connection part 57 is formed at the same position on the left end of each interconnection part so that connection with interconnection lines not shown in the drawing can be facilitated. Each energy-generating element 97, each short interconnection part 55A, and each long interconnection part 55B are shaped like islands by the grooves 91 etched by ion milling.

In FIG. 9, the length LA of each energy-generating element 97 in the longitudinal direction is approximately 700 μm, each short interconnection part 55A is approximately 300 μm, and each long interconnection part 55B is approximately 1000 μm. When the pattern shown in FIG. 9 is formed by ion milling, the fences F are only slightly formed on parts indicated by the arrows F. Further, no fences F adhere to the energy-generating elements 97.

The fences F may be formed on the parts indicated by arrows of energy-generating elements 97 connected with the long interconnection parts 55B. In the third embodiment, however, the fences F are prevented from adhering to the energy-generating elements 97 by providing curved parts 95 formed by partially curving the annular grooves 91 so that the curved parts 95 perform the same function as the above-described island parts.

Further, a description will be given, based on FIGS. 10 through 13, of fourth through seventh embodiments of the present invention. Ink-jet heads shown in these embodiments each include an auxiliary frame body for reinforcing a diaphragm, and are designed so that the fences F are formed on the auxiliary frame body. That is, the auxiliary frame body not only serves to be of assistance to the diaphragm in the ink-jet recording head, but also functions as an island part on which the above-described fences F are formed.

The above-described first through third embodiments each show an arrangement of energy-generating elements in one ink-jet recording head, while the following embodiments each show a case of multiple production where a plurality of heads are produced simultaneously. A large area can be processed by using ion milling in forming energy-generating elements.

Figure 10B:
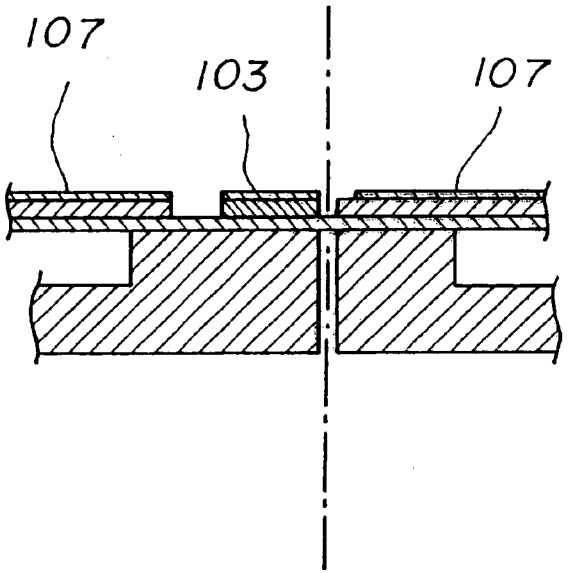
FIGS. 10(A) and (B) are diagrams showing an arrangement of energy-generating elements of an ink-jet recording head according to a fourth embodiment.
Figure 10A:
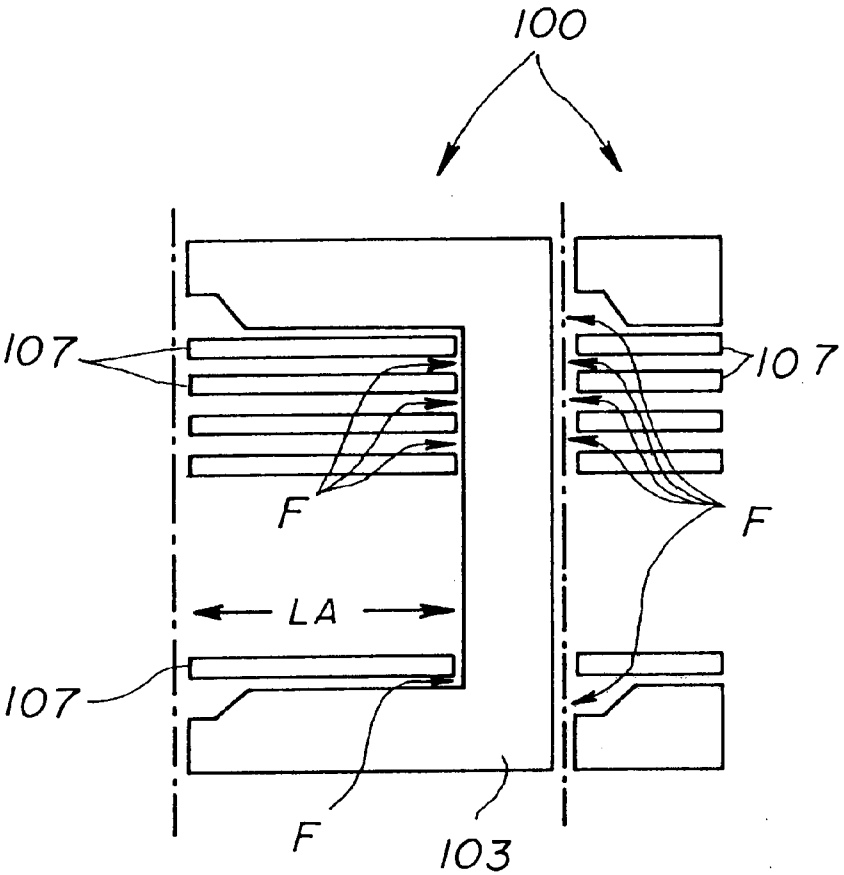

FIG. 10 is a diagram showing an arrangement of energy-generating elements 107 of an ink-jet recording head 100 according to a fourth embodiment of the present invention. FIG. 10(A) is a plan view and FIG. 10(B) is a sectional view of the ink-jet recording head 100. The single-dot chain lines indicate positions along which individual heads are cut off after the production process is completed.

In this embodiment, space exceeding 300 μm, which is the condition of the formation of the fences F in the periphery of the energy-generating elements 107, is reduced as much as possible. Where formation of the fences F is inevitable in light of the design, the fences F are caused to be formed on an auxiliary frame body 103.

FIG. 10 shows two of the ink-jet recording heads 100. Each ink-jet recording head 100 includes the energy-generating elements 107 arranged in parallel and the auxiliary frame body 103 of an angular C letter shape provided to surround the energy-generating elements 107.

In FIG. 10, the distance between adjacent energy-generating elements 107 and the distance between the energy-generating elements 107 and the surrounding auxiliary frame body 103 are each 300 μm or less.

Further, the auxiliary frame body 103 is provided so that its rear face is positioned within 300 μm from the front end of the adjacent ink-jet recording head 100, thereby restricting formation of the fences F as much as possible.

However, if the design requires the longitudinal length LA of each energy-generating element 107 to be approximately 700 μm, space exceeding 300 μm exists between the energy-generating elements 107. Accordingly, there is a possibility that the fences F will be formed.

Thus, in the fourth embodiment, the fences F are formed on the auxiliary frame body 103 as indicated by the arrows F. Therefore, the fences F are prevented from being formed on the energy-generating elements 107.

Figure 11B:
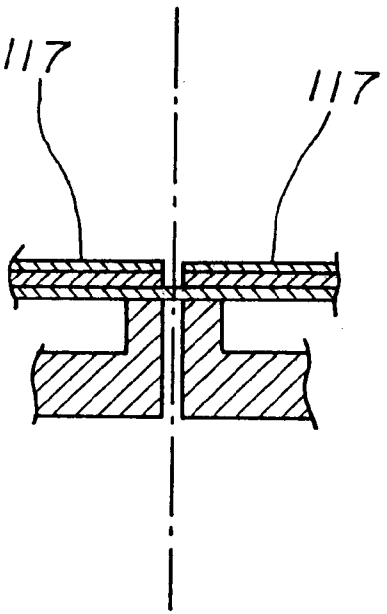
FIGS. 11(A) and (B) are diagrams showing an arrangement of energy-generating elements of an ink-jet recording head according to a fifth embodiment.
Figure 11A:
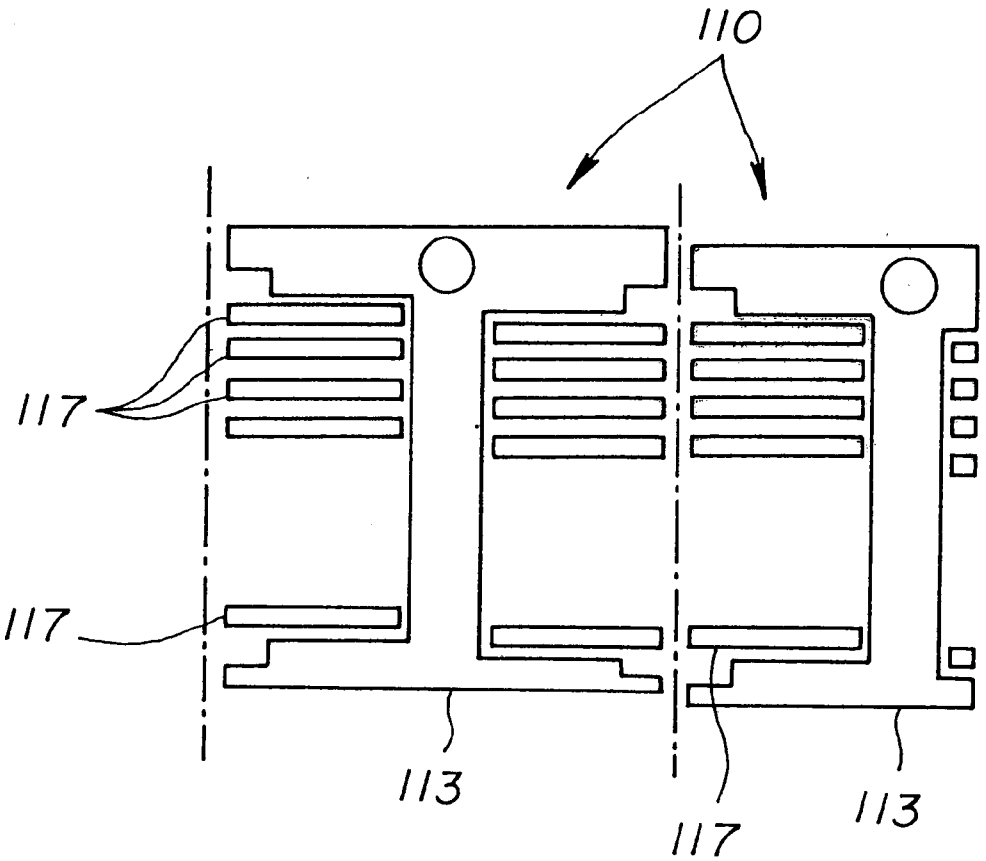

FIG. 11 is a diagram showing an arrangement of energy-generating elements 117 of an ink-jet recording head 110 according to a fifth embodiment of the present invention. FIG. 11(A) is a plan view and FIG. 11(B) is a sectional view of the ink-jet recording head 110. The single-dot chain lines indicate positions along which individual heads are cut off after the production process is completed.

The fifth embodiment is different from the fourth embodiment in that an auxiliary frame body 113 of an I letter shape is provided so as to accommodate the energy-generating elements 117 larger in number. In this embodiment, the energy-generating elements 117 of one of the adjacent ink-jet recording heads 110 are arranged to oppose those of the other ink-jet recording head 110. The distance between each set of opposing energy-generating elements 117 is set to 300 μm or less. In each ink-jet recording head 110, the left and right arrays of the energy-generating elements 117 are offset with respect to each other by the width of the energy-generating element 117 in order to offset the positions of ink nozzles. Accordingly, the adjacent ink-jet recording heads 110 are successively formed in the width direction, being slightly offset in the vertical direction.

As in the fourth embodiment, the fences F are formed on the auxiliary frame body 113 in the fifth embodiment. Therefore, the fences F are prevented from being formed on the energy-generating elements 117.

Figure 12B:
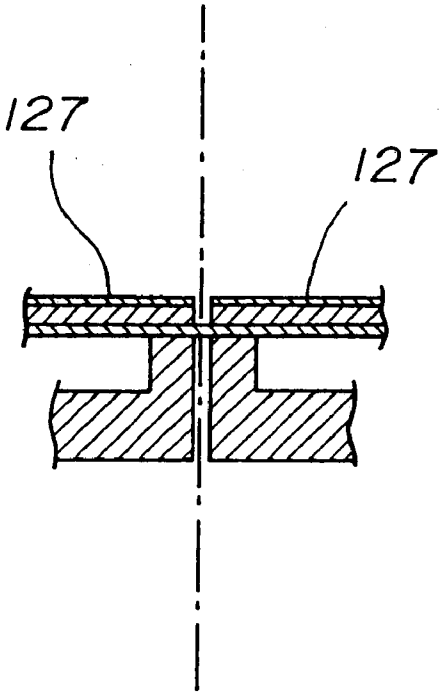
FIGS. 12(A) and (B) are diagrams showing an arrangement of energy-generating elements of an ink-jet recording head according to a sixth embodiment.
Figure 12A:
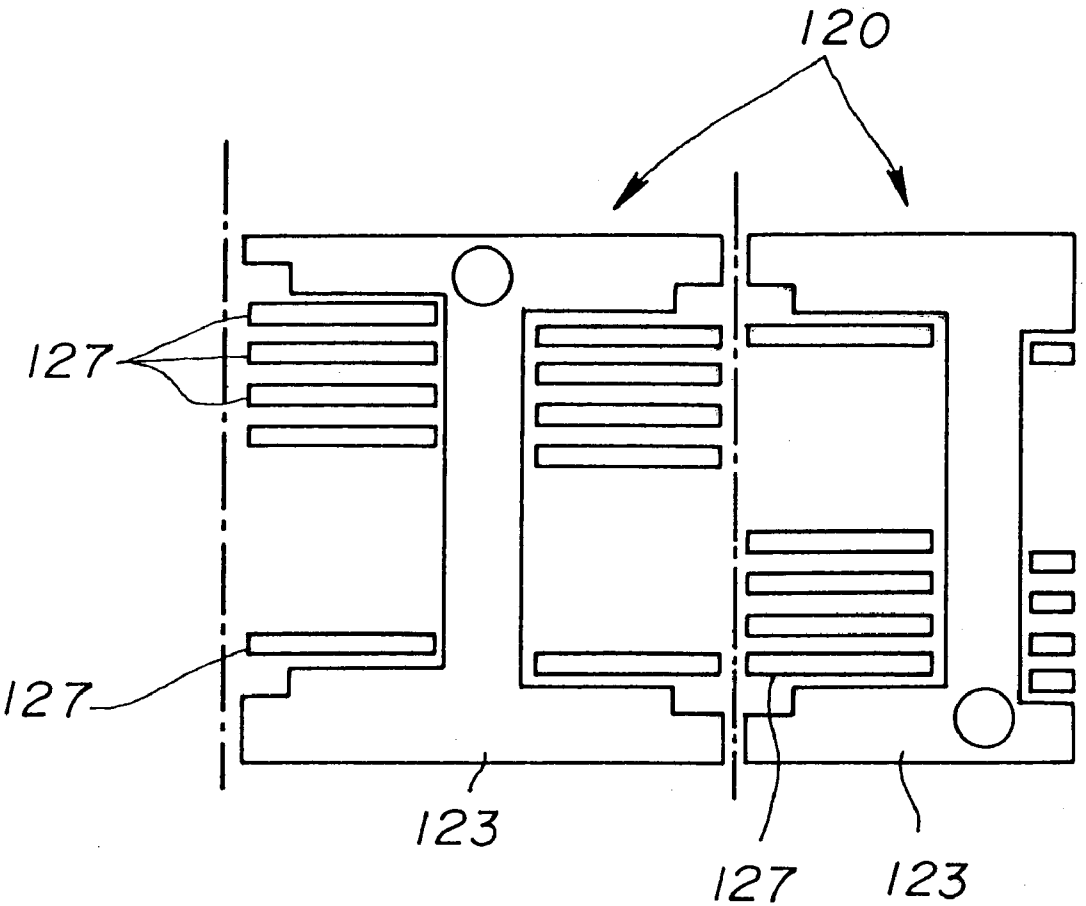

FIG. 12 is a diagram showing an arrangement of energy-generating elements 127 of an ink-jet recording head 120 according to a sixth embodiment of the present invention. FIG. 12(A) is a plan view and FIG. 12(B) is a sectional view of the ink-jet recording heads 120. The single-dot chain lines indicate positions along which individual heads are cut off after the production process is completed.

The sixth embodiment is different from the fifth embodiment in that the adjacent ink-jet recording heads 120 are arranged turned 180° with respect to each other. According to this arrangement, the adjacent ink-jet recording heads 120 can be successively formed without being offset in the vertical direction.

In this embodiment, the adjacent ink-jet recording heads 120 are also arranged so that their respective energy-generating elements 127 oppose each other. The distance between each set of the opposing elements is set to 300 μm or less.

According to the sixth embodiment, the fences F are also formed on the auxiliary frame body 123. Therefore, the fences F are prevented from being formed on the energy-generating elements 127.

Figure 13B:
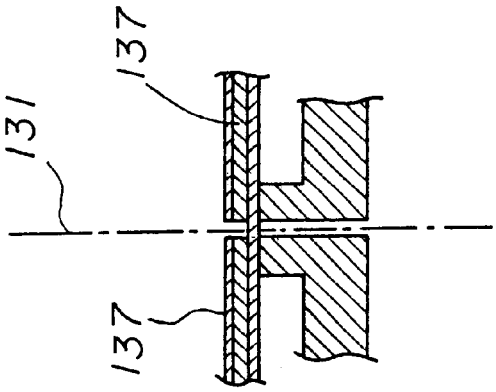
FIGS. 13(A) and (B) are diagrams showing an arrangement of energy-generating elements of an ink-jet recording head according to a seventh embodiment.
Figure 13A:
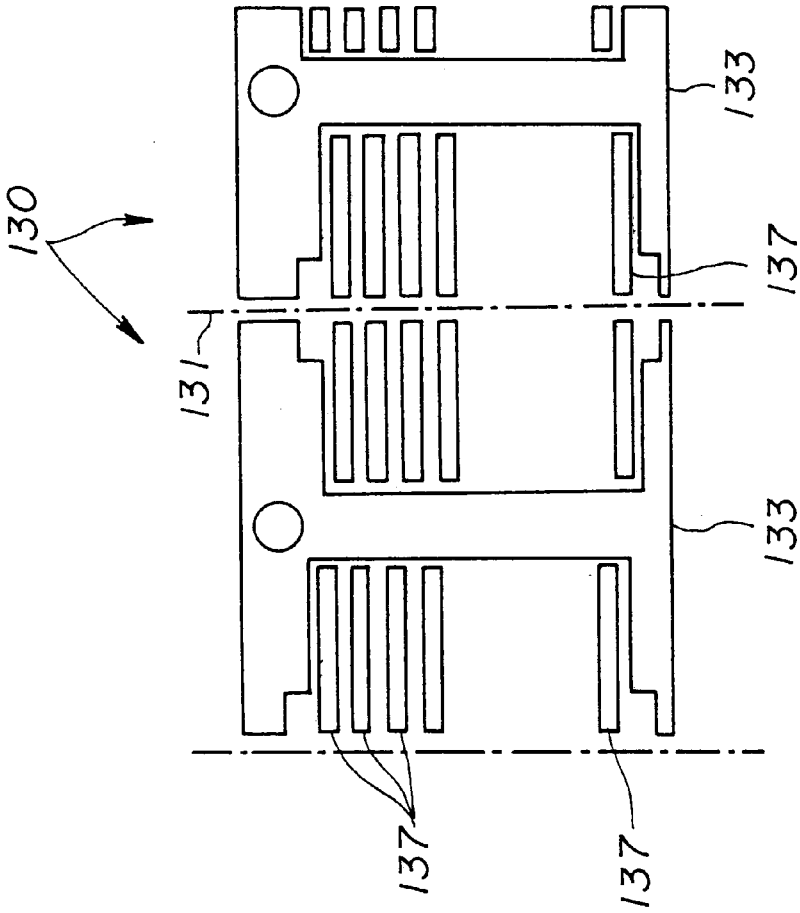

FIG. 13 is a diagram showing an arrangement of energy-generating elements 137 of an ink-jet recording head 130 according to a seventh embodiment. FIG. 13(A) is a plan view and FIG. 13(B) is a sectional view of the ink-jet recording heads 130. The single-dot chain lines indicate positions along which individual heads are cut off after the production process is completed.

The seventh embodiment is different from the sixth embodiment in that the adjacent ink-jet recording heads 130 are arranged symmetrically with respect to a cut-off line 131. This arrangement also allows the adjacent ink-jet recording heads 130 to be successively formed as in the sixth embodiment.

In this embodiment, the adjacent ink-jet recording heads 130 are also arranged so that their respective energy-generating elements 137 oppose each other. The distance between each set of the opposing elements is set to 300 μm or less.

In the seventh embodiment, the fences F are also formed on the auxiliary frame body 133. Therefore, the fences F are prevented from being formed on the energy-generating elements 137.

The description of the ink-jet recording heads of the above-described embodiments is particularly given with respect to their arrangements (patterns) for preventing the fences F from being formed on the energy-generating elements. In the ink-jet recording heads of the above-described embodiments, the fences F are caused to be formed on the island parts, grooves, or auxiliary frame bodies, so that the fences F can be broken and washed away by spraying high pressure liquid or gas thereonto, which therefore can be carried out in a short period at low cost with simple facilities.

Further, a description will now be given, as an eighth embodiment, of the outline of a configuration of an ink-jet recording head 200 and a method of producing the same.

Figure 14:
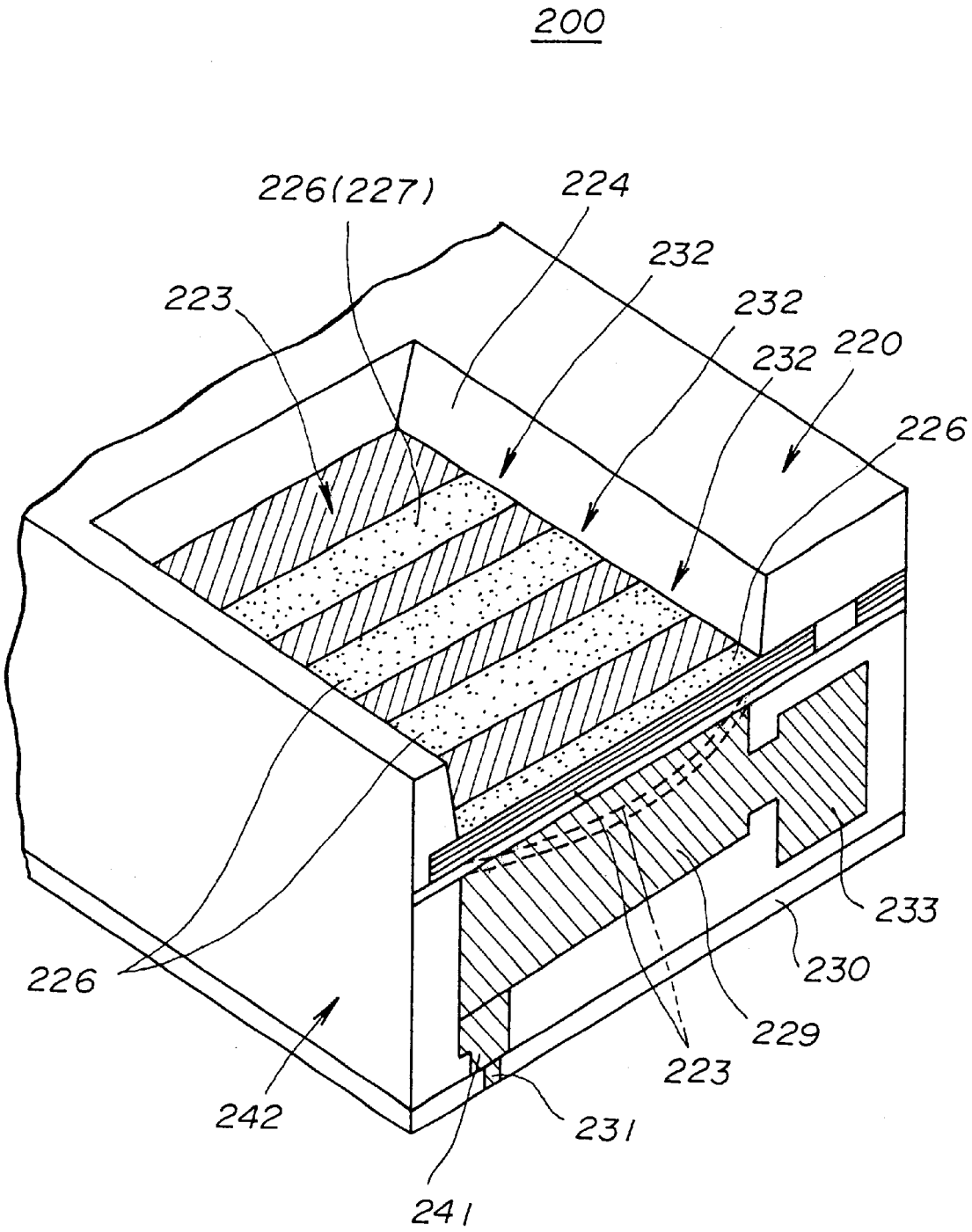
FIG. 14 is a perspective view of an outline of an ink-jet recording head according to an eighth embodiment.

FIG. 14 is a perspective view of the ink-jet recording head 200 of the eighth embodiment, showing the outline thereof. Each energy-generating element 232 formed herein is the rectangle shown in FIG. 6(A).

The ink-jet recording head 200 is composed mainly of a substrate 220, a diaphragm 223, a main body part 242, a nozzle plate 230, and the energy-generating elements 232.

As will be described later, the main body part 242 has a layered structure of dry films, and has a plurality of pressure chambers 229 (ink chambers) and an ink channel 233 serving as an ink supply channel formed thereinside. In the diagram, an open part is formed above the pressure chambers 229, and ink guide channels 241 are formed on the lower surfaces of the pressure chambers 229.

Further, in the diagram, the nozzle plate 230 is provided on the lower surface of the main body part 242, and the diaphragm 223 is provided on the upper surface of the main body part 242. The nozzle plate 230 is formed of stainless steel, for instance, and has nozzles 231 formed at positions opposing the ink guide channels 241.

The diaphragm 223 is a flexible plate-like material formed of chromium (Cr), for instance, and the substrate 220 and the energy-generating elements 232 are provided thereon. The substrate 220 is formed of oxide magnesium (MgO), for instance, and an opening part 224 is formed in the central position of the substrate 220. The energy-generating elements 232 are formed on the diaphragm 223 and are exposed through the opening part 224.

The energy-generating elements 232 are formed of laminations of individual electrodes 226 and piezoelectric elements 227 formed on the diaphragm 223 (functioning as a lower common electrode as well). The energy-generating elements 232 are formed at positions corresponding to positions at which the pressure chambers 229 are formed in the main body part 242.

The individual electrodes 226 are formed of platinum (Pt), for instance, on the upper surfaces of the piezoelectric elements 227. The piezoelectric elements 227 are crystals that generate voltage effect when voltages are applied thereto, and PZT (lead zirconate titanate), for instance, can be used therefor. In this embodiment, the piezoelectric elements 227 are independently formed at the positions where the pressure chambers 229 are formed.

In the ink-jet recording head 200 having the above-described configuration, when voltages are applied between the diaphragm 223 functioning also as a common electrode and the individual electrodes 226, the piezoelectric elements 227 generate distortions due to the piezoelectric effect. When distortions are generated in the piezoelectric elements 227, the diaphragm 223 deforms accordingly.

The distortions generated in the piezoelectric elements 227 at this point cause the diaphragm 223 to deform as indicated by broken lines in the drawing. That is, the diaphragm 223 is configured so as to deform to protrude toward the pressure chambers 229. Therefore, ink in the pressure chambers 229 is pressurized by the deformation of the diaphragm 223 caused by the distortions of the piezoelectric elements 227 so as to be ejected outside through the ink guide channels 241 and the nozzles 231. Thereby, printing is performed on a recording medium such as a sheet of paper.

In the above-described configuration, the diaphragm 223 and the energy-generating elements 232 (the individual electrodes 126 and the piezoelectric elements 127) of the ink-jet recording head 200 of this embodiment are formed by using a thin-film deposition technology. Particularly, the energy-generating elements are formed by simultaneously etching the two layers of an electrode layer and a piezoelectric layer by ion milling.

Next, a description will be given, with reference to FIG. 15, of a method of producing the above-described ink-jet recording head 200.

Figure 15A:
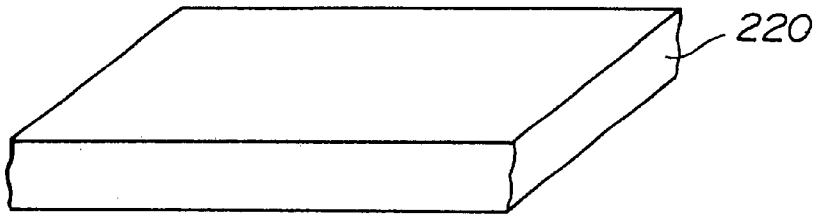
FIGS. 15(A) through (K) are diagrams showing a process for producing the ink-jet recording head shown in FIG. 14.

In order to produce the ink-jet recording head 200, first, the substrate 220 is prepared as shown in FIG. 15(A). In this embodiment, a magnesium oxide (MgO) single crystal of approximately 0.3 mm in thickness is employed as the substrate 220.

Figure 15B:
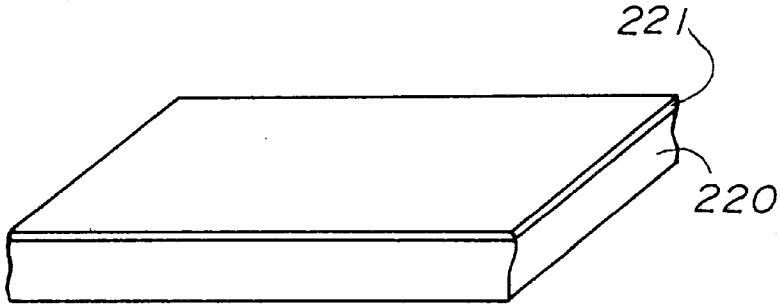
Figure 15C:
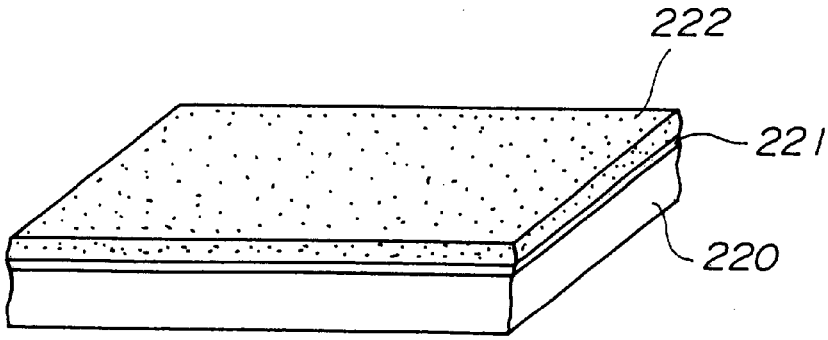

An electrode layer 221 of approximately 0.1 $\mu$m and a piezoelectric layer 222 of approximately 2 to 3 $\mu$m are successively formed on the substrate 220 by using the thin-film deposition technology of sputtering. Specifically, first, the electrode layer 221 is formed on the substrate 220 as shown in FIG. 15(B), and then the piezoelectric layer 222 is formed on the electrode layer 221 as shown in FIG. 15(C). In this embodiment, platinum (Pt) is used for the electrode layer and PZT (lead zirconate titanate) is used for the piezoelectric layer.

Next, etching is performed by ion milling so that laminations of the electrode layer 221 and the piezoelectric layer 222 are formed at the positions corresponding to the pressure chambers. A milling pattern used at this point is formed by a dry film resist (hereinafter referred to as a DF resist). In consideration of the fact that the fences F are formed by ion milling, the milling pattern is a DF resist pattern where island parts on which the fences F are to be formed are arranged.

Figure 15D:
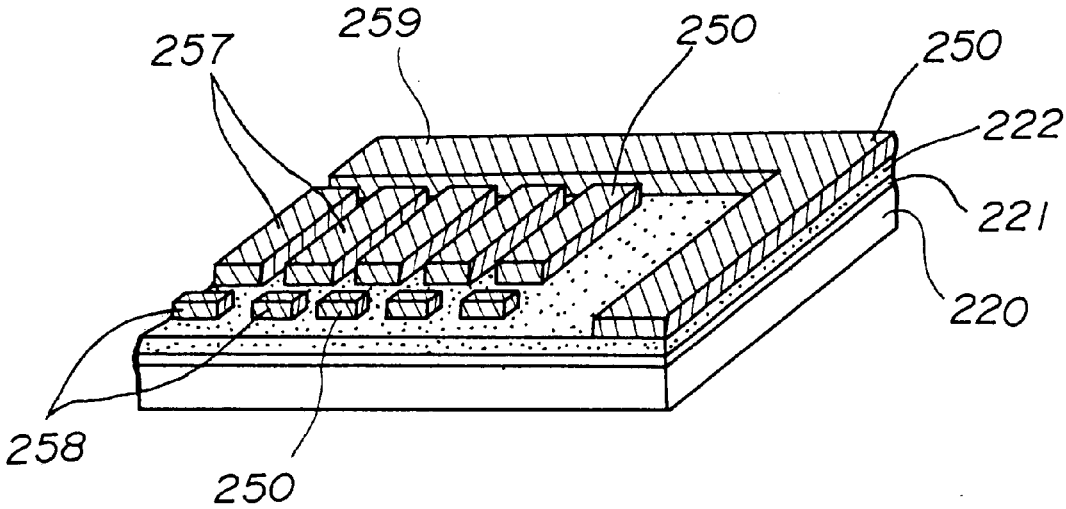

FIG. 15(D) shows a state where the DF resist pattern is formed. In this embodiment, positions 257 where the energy-generating elements 232 are formed, positions 258 where island parts 238 are formed, and a position 259 where an auxiliary frame body 239 is formed are protected as parts to be preserved by a DF resist 250. In this embodiment, FI215 (an alkali-type resist of 15 $\mu$m in thickness: a product of TOKYO OHKA KOGYO CO., LTD.), which was employed as the DF resist 250, was laminated at 2.5 Kgf/cm at 1 m/s at 115 ° C., subjected to exposure of 120 mJ with a glass mask, preheated at 60° C. for ten minutes, cooled down to room temperature, and developed with a 1 wt. % $Na_2CO_3$ solution, so that the pattern was formed.

Next, the substrate 220 was fixed to a copper holder with grease of good heat conductance, and ion milling was performed using only argon (Ar) gas at approximately 700 V at an emission angle of approximately 15°.

Figure 15E:
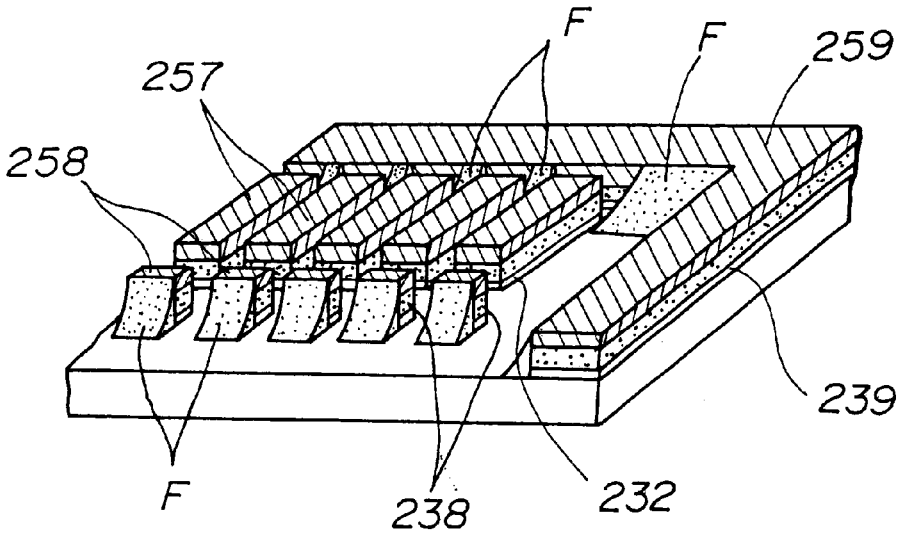

As a result, a state shown in FIG. 15(E) was entered. The taper angle of milled parts in the depth direction had a perpendicularity of over 85° to the lamination surface. Further, as shown in FIG. 15(E), the fences F were formed on the front sides of the island parts 238 (which sides are opposite to the sides on which the energy-generating elements are formed) formed under the positions 258 by ion milling and on the regions of the inner wall of the auxiliary frame body 239 in which regions no energy-generating elements 232 existed.

Figure 15F:
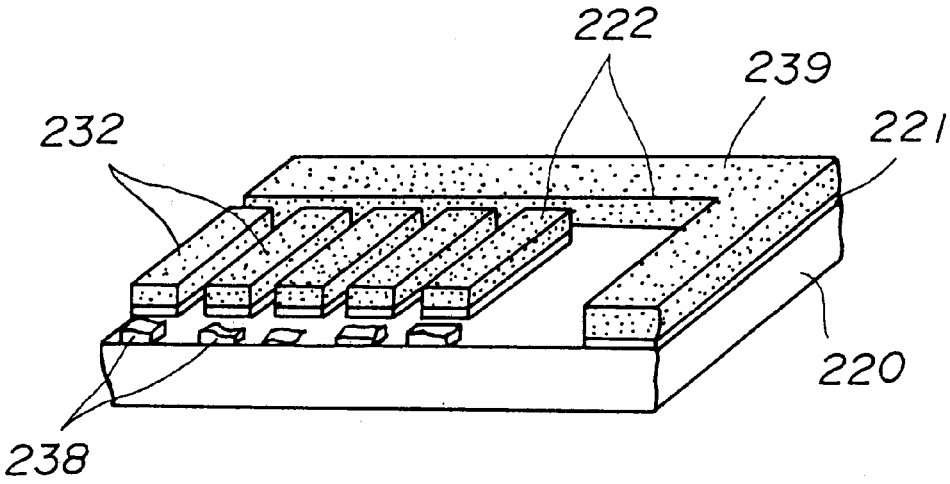

When the DF resist is removed from the state of FIG. 15(E), the fences F remain protruding from the island parts 238 and the auxiliary frame body 239 (See FIG. 5). These fences F were broken and washed away by spraying high pressure water thereonto. FIG. 15(F) shows a state where the fences F were removed.

In FIG. 15(F), in breaking and removing the fences F, the island parts 238 and the auxiliary frame body 239 may also be damaged. The island parts 238, however, are unnecessary components of the ink-jet recording head. Therefore, this poses no problem. Further, even if the auxiliary frame body 239 is partially cracked or damaged, this poses no problem either since the auxiliary frame body is a member for reinforcing the diaphragm 223.

Figure 15G:
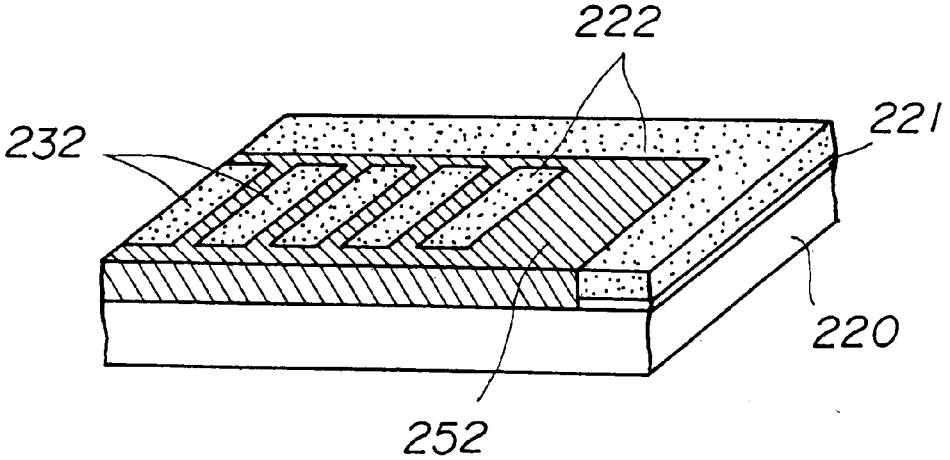

Thereafter, as shown in FIG. 15(G), a planarized insulating layer 252 is formed so that the diaphragm 223 is formed to be flat and the ion-milled parts are insulated.

Figure 15H:
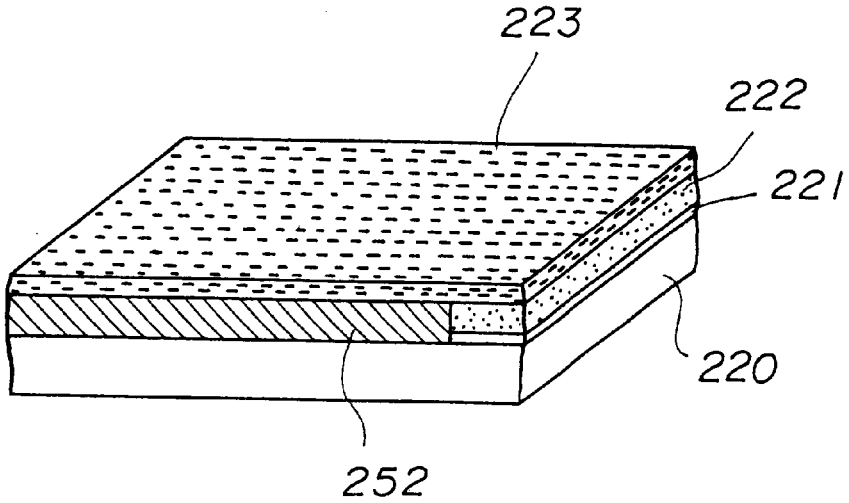

Next, as shown in FIG. 15(H), the diaphragm 223 is formed by sputtering so that the lamination part of the diaphragm 223 and the energy-generating elements 232 serving as parts for generating energy for ink ejection is formed. Ni—Cr or Cr can be used as a material for the diaphragm 223.

Figure 15I:
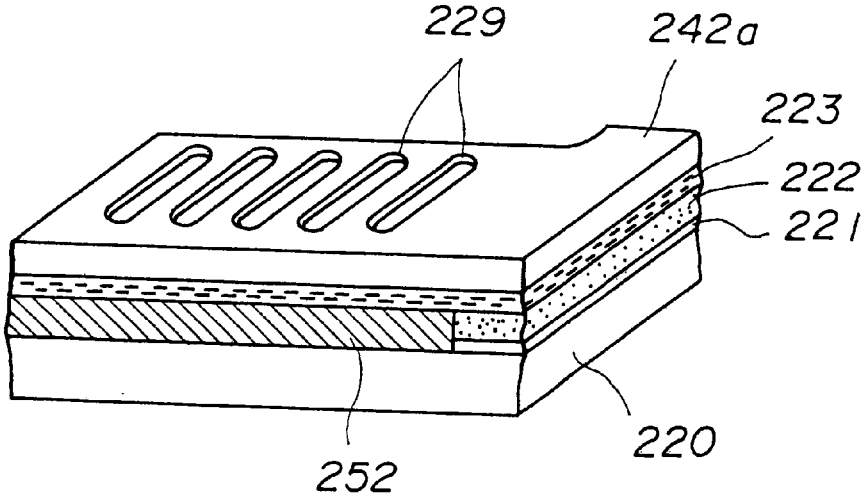

When the formation of the layers 221 through 223 using the thin-film deposition technology including ion milling is thus completed, next, as shown in FIG. 15(I), pressure chamber openings are formed at positions corresponding to the energy-generating elements 232 of the layers 221 through 223. In this embodiment, the pressure chamber openings were formed by using a dry film resist of a solvent type. The dry film resist employed herein was a PR-100 series product (of TOKYO OHKA KOGYO CO., LTD.), and was laminated at 2.5 Kgf/cm at 1 m/s at 35 ° C., aligned and subjected to exposure of 180 mJ by using a glass mask and alignment marks in the pattern of the piezoelectric layer 222 (and the electrode layer 221) at the time of the ion milling, preheated at 60° C. for ten minutes, cooled down to room temperature, and developed with C-3 and F-5 solutions (of TOKYO OHKA KOGYO CO., LTD.), so that the pattern was formed.

On the other hand, a main body part 242*b* having the pressure chambers 229 and the nozzle plate 230 is formed by performing a process different from the above-described process. The main body part 242*b* having the pressure chambers 229 is formed by repetitively performing, a required number of times, lamination, exposure, and development of a dry film (a solvent-type dry film, a PR series product of TOKYO OHKA KOGYO CO., LTD.) on the nozzle plate 230 (having alignment marks not shown in the drawing).

A specific method of forming the main body part 242*b* is as follows. That is, the pattern of the guide channels 41 (60 μm in diameter and 60 μm in depth) for guiding ink from the pressure chamber 229 to nozzles 231 (20 μm in diameter, straight holes) and directing ink flow to one direction is exposed on the nozzle plate 230 (approximately 20 μm in thickness) by using the alignment marks of the nozzle plate 230, and then, like the ink channel 233, the pressure chambers 229 (approximately 100 μm in width, approximately 1700 μm in length, and approximately 60 μm in thickness) are exposed by using the alignment marks of the nozzle plate 230. Thereafter, left out (at room temperature) for ten minutes and subjected to heat hardening (60° C., ten minutes), the dry film had its unnecessary parts removed by solvent development.

Figure 15J:
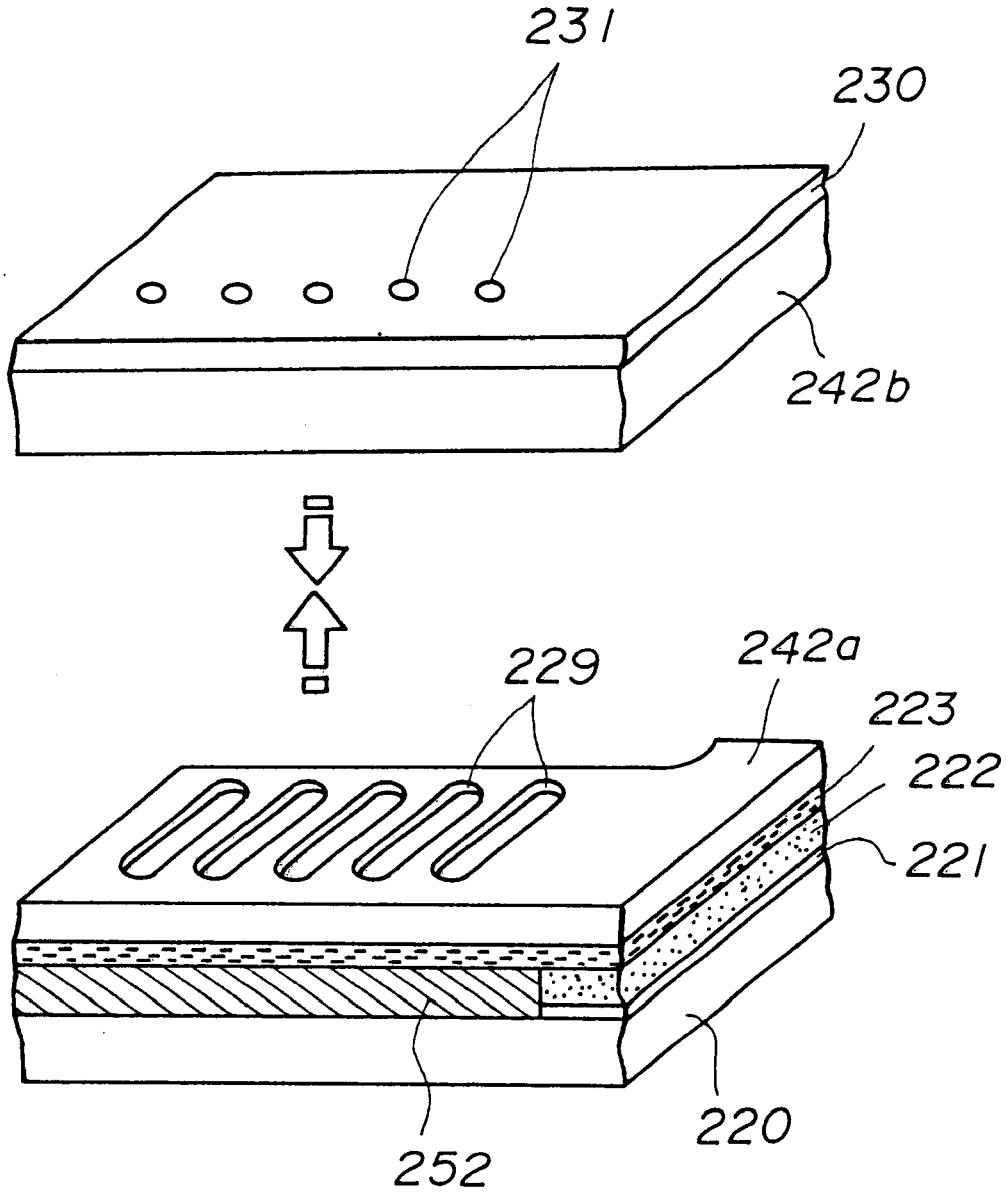

As shown in FIG. 15(J), the main body part 242*b* provided with the nozzle plate 230 thus formed is joined to the other main body part 242*a* having the energy-generating elements 232 (FIG. 15(I)). At this point, the main body parts 242*a* and 242*b* are joined so as to oppose each other with accuracy in the parts of the pressure chambers 229. The joining was achieved using the alignment marks of the energy-generating elements 232 and the alignment marks formed on the nozzle plate 230. Preheating was performed at 80° C. for an hour with a load of 15 Kgf/cm$^2$, permanent joining was performed at 150° C. for 14 hours, and natural cooling was performed.

Next, a region corresponding to a driving part is removed from the substrate 220 so that the energy-generating elements 232 serving as an energy-generating part can oscillate. The substrate 220 is turned upside down so that the nozzle plate 230 is positioned on the lower side, and the substantially central part of the substrate 220 is removed by wet etching so that the opening part 224 is formed.

Figure 15K:
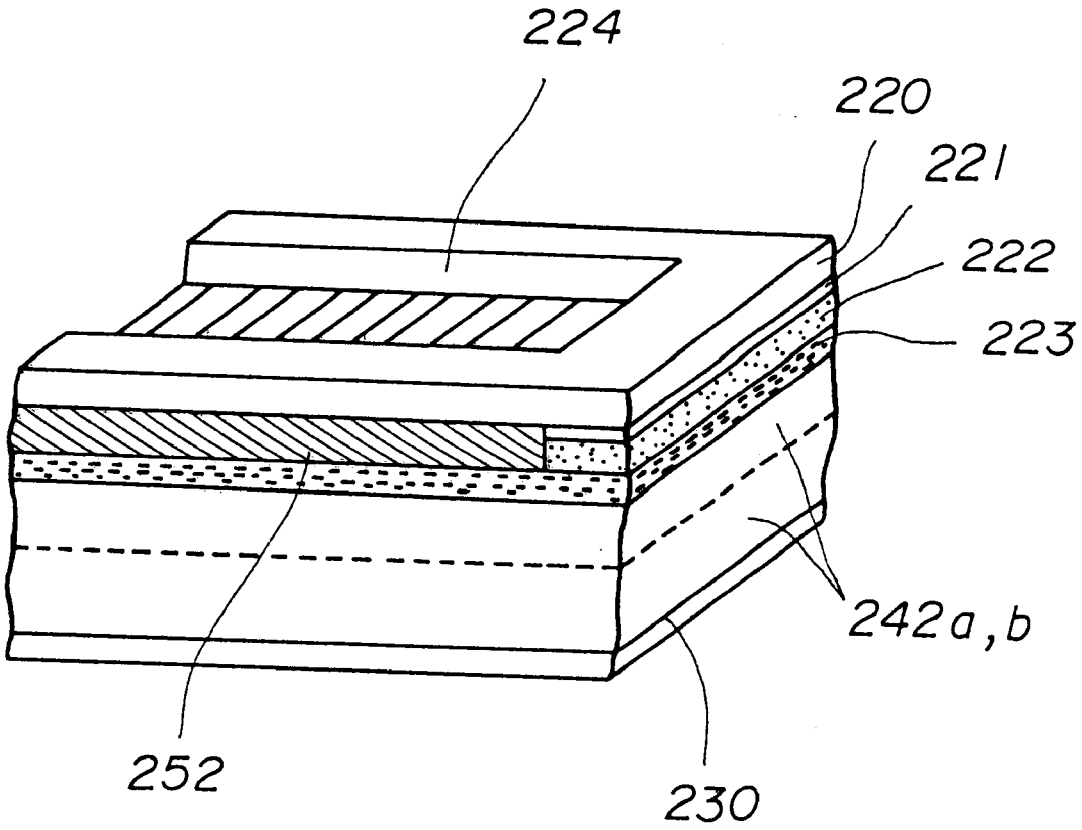

The position at which the opening part 224 is formed is selected to correspond at least to the regions of the diaphragm 223 which regions are deformed by the energy-generating elements 232. By forming the opening part 224 by removing the substrate 220, the individual electrodes 226 (energy-generating elements 232) are exposed through the opening part 224 in the substrate 220 as shown in FIG. 15(K).

As described above, according to this embodiment, the electrode layer 221 and the piezoelectric layer 222 are etched by ion milling at the same time on the substrate 220. Therefore, the energy-generating elements 232 that have a good crystalline characteristic and are free of positioning errors can be formed on the substrate 220. Therefore, energy-generating elements that are thinner than the conventional ones can be formed with high accuracy and reliability.

The, fences F, which are generated in the case of employing ion milling, adhere to the island parts 238 and the auxiliary frame body 239. Therefore, the fences F are prevented from being formed on the energy-generating elements 232. Further, the fences F adhering to the island parts 238 and the auxiliary frame body 239 can be removed by applying thereto physical force by pressurized liquid or gas. Accordingly, a process for removing the fences F can be performed in a short period of time, and the cost of facilities therefor can be controlled.

The island parts 238 and the auxiliary frame body 239 to which the fences F are caused to adhere can be formed easily by altering the pattern of a photoresist. Therefore, this can be achieved easily by using the conventional facilities.

Described in the above-described eighth embodiment is the ink-jet recording head 200 having the island parts 238 and the auxiliary frame body 239 formed therein as fine powder reception parts. By forming annular grooves in the periphery of the energy-generating elements by altering the resist pattern, an ink-jet recording head using the grooves as fine powder reception parts can be formed.

Figure 16:
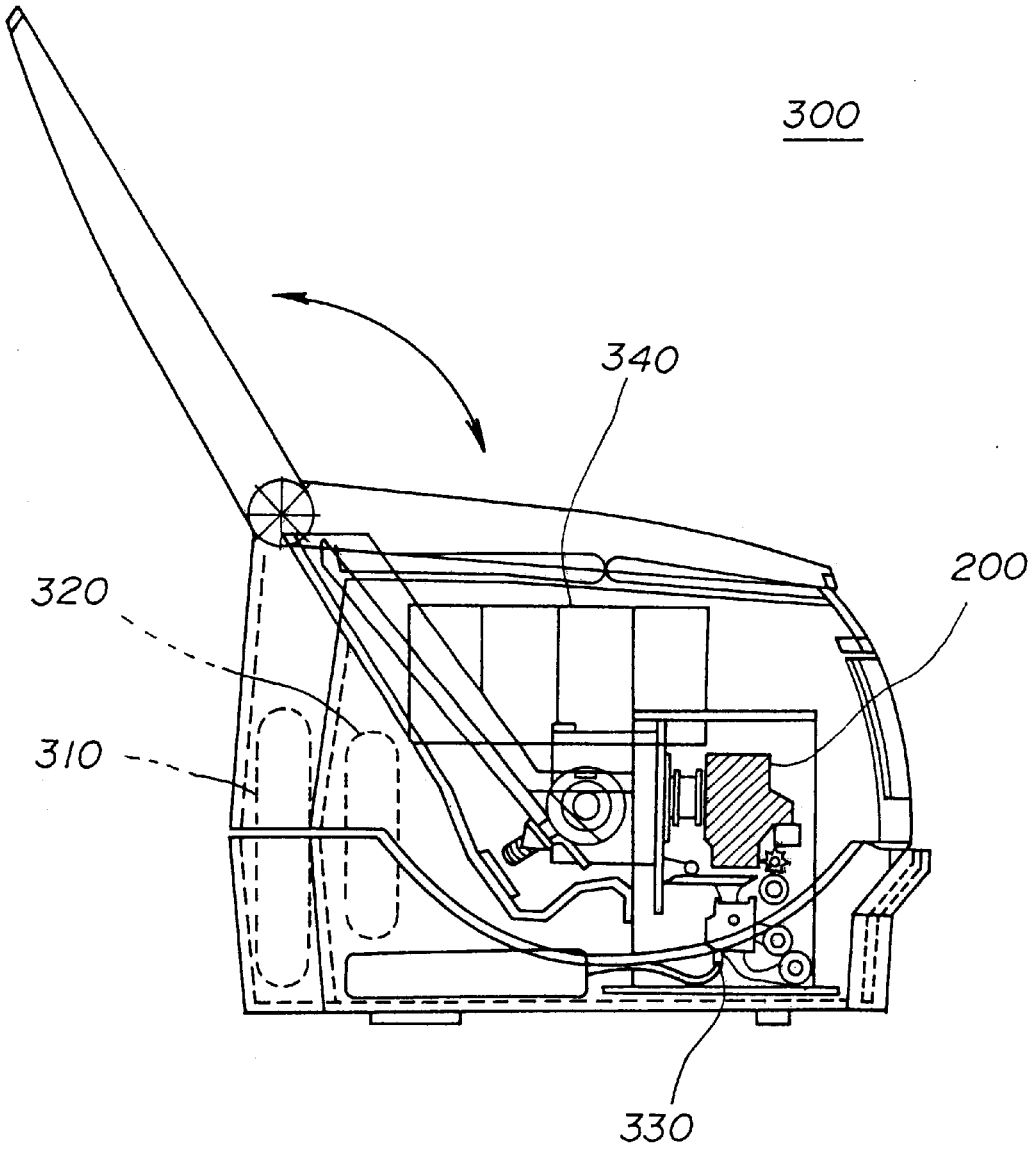
FIG. 16 is a schematic side view of a printer including the ink-jet recording head shown in FIG. 14.

FIG. 16 is a schematic side view of a printer 300 including the above-described ink-jet recording head 200. The printer 300 includes a power supply part 310, a control part 320, an ink cartridge 340, and a backup unit 330. The ink-jet recording head 200 is a downsized head employing a thin-film deposition technology and having high reliability, and can be produced as low cost. Therefore, the printer 300 can provide high-quality images at a low price.

Thus, the description of the preferred embodiments of the present invention is given above, while the present invention is not limited to the specifically disclosed embodiments, but variations and modifications may be made without departing from the scope of the important aspects of the present invention later described in CLAIMS.

Thus, according to the present invention described in detail, in an ink-jet recording head using a thin-film deposition technology, an electrode layer and a piezoelectric layer are etched at the same time by using ion milling. Therefore, energy-generating elements having integrality can be produced.

At this point, unnecessary tapered parts are prevented from being formed on the energy-generating elements.

Further, mixed fine powders generated by ion milling are formed on fine powder reception parts, and therefore are prevented from adhering to the important energy-generating elements.

The mixed fine powders adhering to the fine powder reception parts can be removed easily by the physical force of pressurized liquid or gas, so that the removal process can be performed in a short period of time at low cost.

What is claimed is:

1. An ink-jet recording head in which a piezoelectric layer is formed subsequent to an electrode layer on a substrate by using a thin-film deposition technology and an energy-generating element for generating energy for ink ejection is formed by etching the electrode and the piezoelectric layers simultaneously by an ion milling process, the ink-jet recording head comprising:

a fine powder reception part on which mixed fine powders including at least those etched off the electrode layer and the piezoelectric layer by the ion milling process are deposited, the fine powder reception part being provided in a periphery of the energy-generating element.

2. The ink-jet recording head as claimed in claim 1, wherein said fine powder reception part is an island-like member provided at a position 300 μm or less apart from an end of the energy-generating element.

3. The ink-jet recording head as claimed in claim 2, wherein the island-like member is formed simultaneously when the ion milling process is performed on the electrode and the piezoelectric layers.

4. The ink-jet recording head as claimed in claim 2, wherein the island-like member is an auxiliary frame body for reinforcing the ink-jet recording head.

5. The ink-jet recording head as claimed in claim 4, wherein the auxiliary frame body is formed simultaneously when the ion milling process is performed on the electrode and the piezoelectric layers.

6. The ink-jet recording head as claimed in claim 1, wherein said fine powder reception part is an annular groove provided around the energy-generating element so that the energy-generating element is formed therein.

7. The ink-jet recording head as claimed in claim 6, wherein the groove is 300 $\mu$m or less in width.

8. The ink-jet recording head as claimed in claim 7, wherein the groove is formed simultaneously when the ion milling process is performed on the electrode and the piezoelectric layers.

9. A printer comprising:

an ink-jet recording head wherein a piezoelectric layer is formed subsequent to an electrode layer on a substrate by using a thin-film deposition technology and an energy-generating element for generating energy for ink ejection is formed by etching the electrode and the piezoelectric layers simultaneously by an ion milling process, the ink-jet recording head comprising:

a fine powder reception part on which mixed fine powders including at least those etched off the electrode layer and the piezoelectric layer by the ion milling process are deposited, the fine powder reception part being provided in a periphery of the energy-generating element.

* * * * *